US010597881B1

(12) United States Patent
Huguet, Sr. et al.

(10) Patent No.: US 10,597,881 B1
(45) Date of Patent: Mar. 24, 2020

(54) WALL SYSTEM

(71) Applicants: Rafael Huguet, Sr., Miami, FL (US); Rafael Huguet, Jr., Pinecrest, FL (US)

(72) Inventors: Rafael Huguet, Sr., Miami, FL (US); Rafael Huguet, Jr., Pinecrest, FL (US)

( * ) Notice: Subject to any disclaimer, the term of this patent is extended or adjusted under 35 U.S.C. 154(b) by 0 days.

(21) Appl. No.: 16/506,165

(22) Filed: Jul. 9, 2019

Related U.S. Application Data

(63) Continuation-in-part of application No. 16/053,267, filed on Aug. 2, 2018, now abandoned.

(51) Int. Cl.

| | |
|---|---|
| ***E04G 11/06*** | (2006.01) |
| ***E04G 17/00*** | (2006.01) |
| ***E04B 1/64*** | (2006.01) |
| ***E04C 2/06*** | (2006.01) |

(52) U.S. Cl.
CPC ..... *E04G 11/06* (2013.01); *E04B 1/64* (2013.01); *E04C 2/06* (2013.01); *E04G 17/007* (2013.01)

(58) Field of Classification Search
CPC ..... E04G 11/06; E04G 11/067; E04G 17/04; E04B 2/8647; E04B 2002/8688
See application file for complete search history.

(56) References Cited

U.S. PATENT DOCUMENTS

| | | | | |
|---|---|---|---|---|
| 1,578,344 A | | 3/1926 | Munroe | |
| 2,142,305 A | | 1/1939 | Davis | |
| 2,381,635 A | | 8/1945 | Baker | |
| 2,915,150 A | | 12/1959 | Weidler | |
| 3,190,407 A | | 6/1965 | Arthur | |
| 3,293,812 A | | 12/1966 | Hammit | |
| 3,358,411 A | | 12/1967 | Birum, Jr. | |
| 3,683,576 A | | 8/1972 | Sikes | |
| 3,698,147 A | * | 10/1972 | Sikes | E04B 1/6141 52/276 |
| 3,888,059 A | | 6/1975 | MacLennan et al. | |
| 4,037,379 A | | 7/1977 | Ozannw | |
| 4,057,948 A | | 11/1977 | Wise | |
| 4,201,020 A | | 5/1980 | Saunders | |

(Continued)

FOREIGN PATENT DOCUMENTS

| | | |
|---|---|---|
| DE | 2802151 A1 | 7/1979 |
| DE | 10304358 A1 | 8/2004 |

(Continued)

*Primary Examiner* — Christine T Cajilig
(74) *Attorney, Agent, or Firm* — Malloy & Malloy, PL.; Peter A. Matos

(57) ABSTRACT

A wall system including a plurality of panel assemblies, each having a reduced thickness for use in connection with a portion of a building structure. The panel assembly comprises two panel members disposed in interconnecting relation, collectively defining an air gap that is generally filled with a filler material such as concrete. Removable support members are further included and disposed on an outside face of a corresponding panel member. The removable support members may comprise corrugated steel panels that may be held in place along with the panel members by retainers that interconnect the panels and/or removable support members. Wire mesh may be disposed within the air gap. One or more panel assemblies may be interconnected via a connecting assembly. The connecting assembly may comprise a U-shaped channel with one or more apertures.

19 Claims, 18 Drawing Sheets

(56) References Cited

U.S. PATENT DOCUMENTS

| | | | | |
|---|---|---|---|---|
| 4,443,988 | A | 4/1984 | Coutu, Sr. | |
| 4,542,614 | A | 9/1985 | Malachowski | |
| 4,689,930 | A | 9/1987 | Menchetti | |
| 5,010,702 | A | 4/1991 | Daw et al. | |
| 5,072,569 | A | 12/1991 | Vantassel | |
| 5,483,778 | A | 1/1996 | Scrivener | |
| 5,566,523 | A | 10/1996 | Ozanne | |
| 5,638,651 | A | 6/1997 | Ford | |
| 5,822,940 | A | 10/1998 | Carlin | |
| 6,044,603 | A | 4/2000 | Bader | |
| 6,112,851 | A | 9/2000 | Sugimoto | |
| 6,256,960 | B1* | 7/2001 | Babcock | E04B 1/14 52/281 |
| 6,263,628 | B1 | 7/2001 | Griffin | |
| 6,698,710 | B1* | 3/2004 | VanderWerf | E02D 27/02 249/159 |
| 6,843,035 | B1 | 1/2005 | Glynn | |
| 7,568,318 | B1 | 8/2009 | Egan | |
| 7,900,411 | B2 | 3/2011 | Antonic | |
| 9,133,620 | B1 | 9/2015 | Huguet | |
| 2002/0117086 | A1* | 8/2002 | Shi | C04B 28/02 106/672 |
| 2004/0089786 | A1* | 5/2004 | Tamura | E04B 2/8647 249/13 |
| 2004/0255539 | A1 | 12/2004 | Beavers et al. | |
| 2007/0062144 | A1* | 3/2007 | Moon | E04B 1/161 52/481.1 |
| 2007/0094992 | A1 | 5/2007 | Antonic | |
| 2008/0224023 | A1* | 9/2008 | Stefanutti | E04B 2/8647 249/196 |
| 2009/0000214 | A1 | 1/2009 | Stanley | |
| 2009/0064619 | A1 | 3/2009 | Bowerman | |
| 2009/0282759 | A1 | 11/2009 | Porter | |
| 2011/0162306 | A1 | 7/2011 | Stanley | |
| 2011/0265412 | A1 | 11/2011 | Sharpe | |
| 2011/0302867 | A1 | 12/2011 | Parshad | |
| 2013/0074432 | A1* | 3/2013 | Ciuperca | E04B 1/21 52/309.4 |
| 2013/0119228 | A1* | 5/2013 | Kamata | E04B 2/8635 249/15 |
| 2013/0192156 | A1* | 8/2013 | Tims | E04B 2/26 52/404.2 |
| 2014/0059958 | A1 | 3/2014 | Ratto Anduaga | |
| 2017/0218614 | A1* | 8/2017 | Ciuperca | E04G 17/14 |
| 2017/0328060 | A1* | 11/2017 | Strickland | E04B 2/8635 |
| 2018/0112389 | A1* | 4/2018 | Lake | E04B 1/16 |
| 2019/0226218 | A1* | 7/2019 | Hieb | E04G 11/08 |

FOREIGN PATENT DOCUMENTS

| | | |
|---|---|---|
| GB | 2355732 | 5/2001 |
| WO | WO2012120223 | 9/2012 |

* cited by examiner

FIG.13A
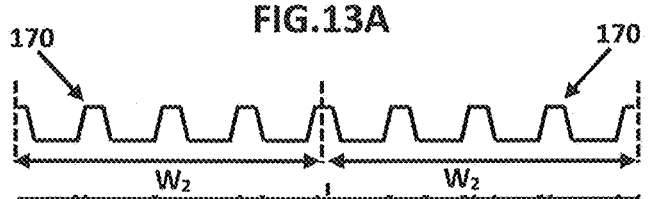
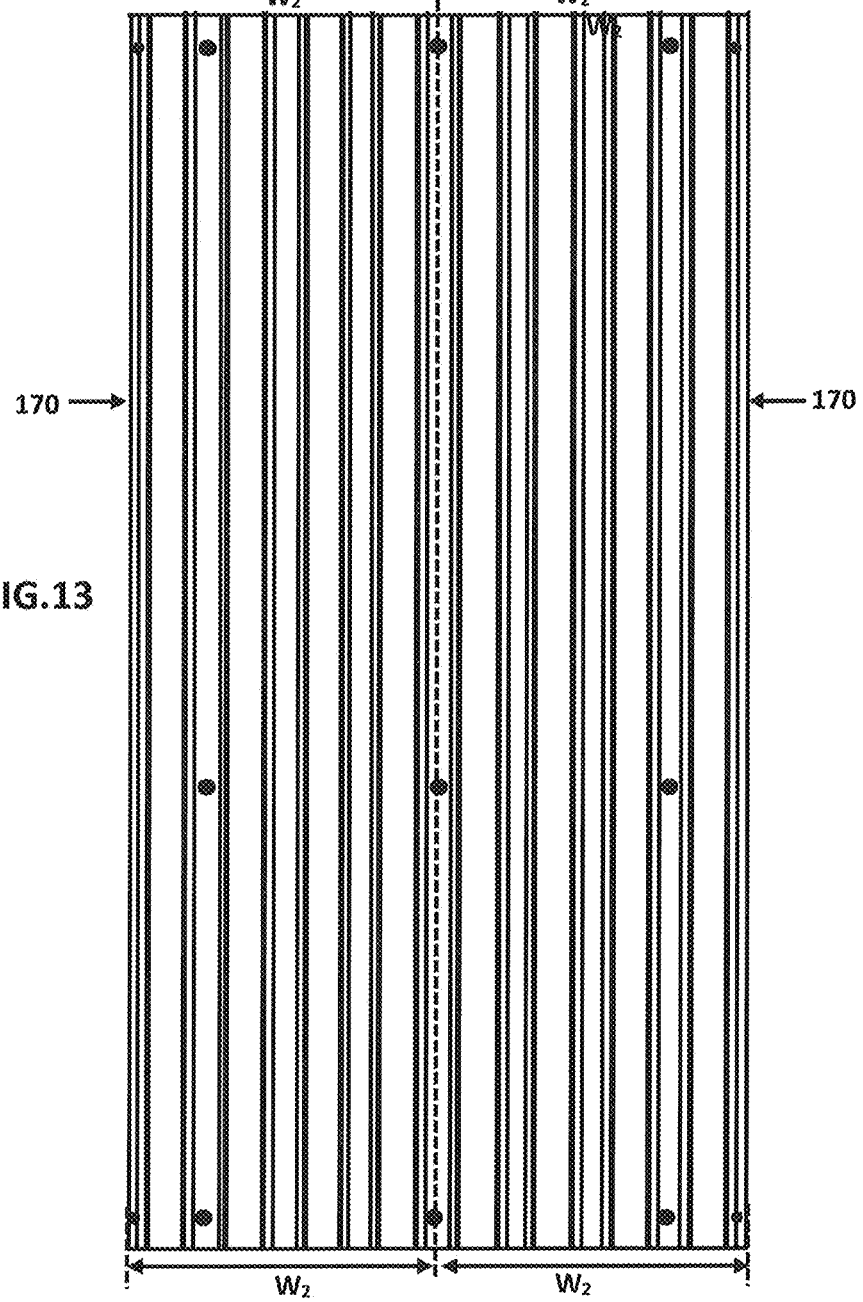
FIG.13

WALL SYSTEM

CLAIM OF PRIORITY

The present application is a continuation-in-part application of previously filed, pending application having Ser. No. 16/053,267, filed on Aug. 2, 2018.

BACKGROUND OF THE INVENTION

Field of the Invention

The present invention is directed to a wall system that incorporates a series of panel assemblies, which may be quickly and easily constructed into structural (multi-story) walls. Specifically, the present invention is directed to a less expensive and more efficient system of exterior panel assemblies, which may be constructed into exterior walls of a structure without the need for additional exterior surfacing.

Description of the Related Art

Construction of exterior structural walls is often a very labor intensive, time consuming and complex process, requiring a series of construction phases. For example, in most traditional construction settings, a jobsite must be prepared with footings and appropriate reinforcements, then a series of ply-wood molds or forms are positioned to receive concrete. These ply-wood molds define a shape of the concrete and require extensive amounts of additional support beams and reinforcements to keep the molds in place under the pressure and weight of the concrete that is introduced into the molded area. As can be appreciated, these reinforcement posts are typically angled and take up a significant amount of additional space and require significant amounts of added lumber and lumber costs. Thereafter, once the concrete has hardened, these wooden molds and supports must be removed, and due to the porous and breakable nature of the wood and the inability to clean the wood, they are discarded the expenditure being attributed to a sunk cost of the molding process. Thereafter, once the molds are removed, the normal setting of the concrete invariably results in the formation of air pockets or deformations which, while in most cases not impacting the structural integrity of the wall, do provide an unappealing aesthetic for most applications. As a result, additional surfacing such as stucco or the addition of siding is required, adding yet another cost and phase to the process. Further, because it is solely the molded concrete and interior reinforcements that make up the structural integrity of the wall, these structural walls are typically made up of a larger thickness to meet the needed demands, thereby requiring more concrete and reducing interior space.

Conversely, prefabricated construction techniques often include the assembly of components of a structure in a controlled plant and the transportation of the assembled components to a jobsite to be constructed. As opposed to traditional construction techniques, prefabrication provides a host of benefits such as shorter construction times, cost effectiveness, etc. A problem that exists with traditional prefabricated molded wall panels, however, involves the heavy weight that makes it expensive and difficult to transport, manipulate and tie in the panels without the use of heavy equipment. Further, transport can introduce flaws or cracks and results in points of potential weakness as seams are formed between the wall panels and vertical structural elements such as corner posts.

Accordingly, it would be beneficial to develop a system that builds upon the benefits of an efficient wall system by eliminating the need for complex, costly and wasteful wood molding and reinforcement, while also addressing other needs felt in the art, by providing generally lightweight panel assemblies that may be prefabricated, or that may be assembled quickly and efficiently at the jobsite, and used to act as concrete forms which substantially remain in place as integral parts of structural walls. The panel assemblies may be integrally formed with columns, tie beams, base tracks, etc. in a manner that provides added strength in a smaller form factor and provides a finished appearance that does not require additional surfacing. Other benefits of the present invention will be illuminated in the sections below.

SUMMARY OF THE INVENTION

The present invention is directed toward a wall system that incorporates the use of panel assemblies which may be quickly and easily assembled into structural interior walls. Each panel assembly may be constructed from two panel members disposed in spaced relation to each other and connected via a plurality of connecting members which can be assembled at the jobsite or pre-assembled in the factory. As discussed in further detail below, the connecting members may be roll-formed steel "U" shaped structural channels or steel plates. In addition, the present invention may include a base member which comprises an elongated structural channel acting as a template that can be disposed along and affixed to, for example, a concrete slab of which the present invention is to be erected. The base member may be a "U" shaped steel track channel deployed longitudinally along a concrete slab including apertures that act as a template for unskilled laborers to set steel dowels, reinforcing steel, etc. through the apertures to the concrete slab.

End-users may include reinforcing steel rebar, steel dowels, etc. for enhanced strength to the invention. Thus, steel rebar may extend the length of the panel assembly and into an aperture of the base member. The reinforcing steel rebar may be placed between interconnected panel members and extend the length thereof and extend through the base member aperture to allow concrete to be poured after this pre-set construction is completed. As such, steel rebar, etc., may be connected to the concrete slab for additional support to the structure. In another embodiment, a steel dowel (e.g., #5 dowel) may be connected and extend up from the concrete slab through an aperture of the base member and be tied to steel rebar for additional support to the structure.

Furthermore, this assembly is less expensive and less time consuming relative to traditional construction methods. The present invention provides a superior wall construction in several ways. For example, in traditional construction methods, wood forms are generally used at jobsites to cast concrete, but are usually thrown away after just one time when the concrete dries. In addition, when the wood forms are removed they rip away pieces of concrete with them, and as such take additional time and concrete to re-patch such areas. However, the interconnected panel assemblies of the present invention are capable of acting as permanent concrete forms which remain in place and serve as an integral part of the structure. Thus, the present invention is less expensive and more efficient than a traditional exterior wall construction. Further, the edges of the permanent concrete forms may be covered with compound without the need to apply stucco thereon.

In addition, the panel assemblies of the present invention are capable of being manufactured in a controlled environment. This dispenses with the need to perform inspections on-site, which can cause delays. Thus, the present invention is much quicker and less expensive than a traditional exterior wall construction. Furthermore, the factory construction is particularly amenable to template-based construction lending to more uniformity between panel assemblies relative to traditional construction methods.

Further, the panel members are capable of being made from lightweight and less expensive materials, such as fiber cement, magnesium sulfate, magnesium oxide, lightweight cement, wall paneling, etc. which also provide for lightweight walls which are easy to handle and assemble, but also provide strength to prevent shearing and/or cracking as is the case of walls constructed of concrete blocks, and other materials. These panels are also intended to remain in place and provide a finished appearance to the completed wall structure.

One or more panel assemblies may be deployed as exterior wall segments as desired. The above-mentioned plurality of connecting members also serve as interconnecting means to panel assemblies which facilitate the quick and easy erection process of the exterior walls. The base member which comprises an elongated "U" shaped structural channel acting as a template can be disposed along and affixed to, for example, a concrete slab of which the present invention is to be erected. The connecting U-shaped channels and steel plate members may extend the length of the panel member to rest on the foundation concrete slab or be disposed on or within the channel of the base member. The base member can facilitate erection of a plurality of panel assemblies into an exterior wall structure. Further, the base member and connecting members act to hold the panel assemblies in place, preventing the panel assemblies from moving.

The base member may include one or more operative features to facilitate a secure retention to the concrete slab. For example, the base member may include a plurality of apertures or pre-punched holes or slots running longitudinally on the surface which abuts the concrete slab. Thus, a structural reinforcement, such as pre-set steel dowels (e.g., 1½ inch) and/or reinforcing bars ("rebar") may be effectively utilized to pass through the apertures and be secured directly to the concrete slab.

As mentioned above, the panel assembly may be constructed from two panel members disposed in spaced relation and connected via a plurality of connecting members. The panel members are substantially planar, being much larger in length and width than in thickness, and also substantially rigid and moisture resistant so as to not deform under their own weight or the buckling effect of a variety of filler (e.g. concrete) therebetween. In addition, snap ties may be used, but are not required. However, the thickness of the panel members may be increased or decreased, depending upon the desired use and deployment of the system.

Another operative feature of the present invention is the spaced relation of the assembled panel members. The spaced relation may provide an air gap in between the correspondingly disposed panel members in which, for example, concrete or other filler may be disposed in order to further enhance the added strength of the panel assemblies. However, the air gap may also be filled with slate, clay, or other suitable materials readily found at the jobsite. In addition, pre-set wire mesh may be installed on the inner walls of the panel members for added tension and strength. Further, the air gap may also include conduits for electric wiring and/or pre-set plumbing stacks.

It may be desirable to allow users of the present invention to dispose their own desired filler material within the air gap at the jobsite. Connecting members may be disposed at the ends of abutting panel members in order to increase the structural strength of the panel assembly. For example, two panel assemblies may be interconnected, such as by a typical 'tongue and groove' connection of two corresponding "U" shaped connecting members which may form a structural channel therebetween, as described in greater detail below.

A connecting member of the present invention is generally an elongate and rigid structure which includes facilities for the secure attachment of panel members thereto. In at least one embodiment, a connecting member may comprise a structural channel such as in the form of a "U" shaped channel mentioned above. Such a "U" shaped channel can be made of strong but flexible material such as steel. As mentioned above, each panel member of a panel assembly may be securely attached to each other via a connecting member, creating spacing or an "air gap" therebetween.

Aside from enhancing the structural strength and/or rigidity of a panel assembly, the U-shaped channels with apertures or steel plate connecting members may also be used to allow the flow of liquid fillers between different sections, and may also be utilized to facilitate erection of a plurality of panel assemblies by providing a relatively easy connection means between adjacent panel assemblies. A connecting member may comprise two adjacently disposed L-shaped angles that may be disposed on at least one end of a panel assembly and extending therefrom. Two panel assemblies may be disposed in interconnecting relation via corresponding "U" shaped connecting members and forming columns therebetween. This interconnection of two "U" shaped connecting members comprises a double wall along the length of the panel members for additional bending strength. In a further embodiment, two different panel assemblies may be disposed in interconnecting relation via L-shaped angles structured to allow insertion of reinforcement bars, e.g., angle bars, at corner columns.

An easy erection method may be performed whereby the connecting member of one panel assembly may be disposed within the connecting member of an adjoining panel assembly and so forth until a desired length of wall or partition is accomplished. The panel members and panel assemblies may be securely retained by inserting screws, bolts, etc. to secure the panel members and panel assemblies to the connecting members.

In embodiments where the connecting members comprise structural channels, or "U" shaped channels, the interconnected connecting members may be correspondingly oriented and disposed such that upon insertion of a connecting member of one panel assembly within a connecting member of another panel assembly, the corresponding connecting members are disposed in a 'tongue and groove' connection or substantially telescopically interconnected. Thusly, disposed, the joints of each adjoining panel assembly are strengthened twofold. Further, at least some of the elongate connecting members may extend the length of the panel members such that the lowermost portion thereof is disposed on or within the channel of the base member, as described in greater detail below, and this region can also be filled with concrete or an appropriate fill to add further structural integrity.

It will be appreciated that in use of the present invention a plurality of panel assemblies will generally be required in order to construct an exterior wall of a desired length. As desired, each panel assembly may be the same or of differing sizes, but generally each panel assembly will include both a connecting member at each end.

As used herein, the term "exterior wall" refers to walls which define the exterior boundary of a structure, in distinction to an "interior wall" (that can also be structural or of conventional drywall) which can define interior boundaries within a structure. For ease of reference, the panel members of the exterior panel assembly may be defined as including an exterior panel member and an interior panel member. The exterior panel member being the panel member which faces the exterior of the structure, the interior panel member (which can also be a structural wall) being the panel member which faces the interior of the structure.

The exterior panel assembly system may also include a corner assembly, whereby exterior panel assemblies are adjoined at an angle via L-shaped sections disposed to allow setting of reinforcing steel bars to enhance structural characteristics of corner columns. As such, a corner may be created. Accordingly, additional hardware and fasteners may be utilized in order to provide for an angled interconnection including structural integrity wind load. In describing a corner assembly, an end panel assembly may be defined for ease of reference, with an end panel assembly comprising an exterior panel assembly that at least partially comprises the corner assembly. In a preferred embodiment, a vertical support structure may be included to enhance structural stability and may comprise steel rebar and/or steel dowels (e.g., "L" shaped rebar corner bars).

The present invention is also directed to a wall system that can employ a reduced thickness that may be used as a portion of a building structure, generally as an exterior or interior structural wall. The inventive wall system generally comprises two panel members disposed in interconnecting relation, for example via retainers, which collectively define a panel assembly. The panel members collectively define an air gap that is generally filled with a filler material, such as for example, concrete. It is within the scope of the present invention that the panel members themselves be moisture resistant so that they do not decompose or deflect when coming into contact with a liquid(s), e.g. moisture content of the concrete or in the case of an exterior wall, environmental moisture. That is, the material of the panel members should be such that the panels should at least partially resist absorption to moisture from the filler material, e.g., concrete, or from the environment, i.e., humidity, rain, etc. The wall system may also comprise removable support member(s) disposed on an outside face of a corresponding panel member of the panel assembly. The removable support members are intended to provide enhanced structural support to the filler materials to at least partially reduce bowing, buckling, and/or deflection of the panel members during filling and hardening. As such, the removable support members may comprise corrugated steel panels. The removable support members also eliminate the need to incorporate panel members having an increased thickness, and as they do not act as a mold and/or come into contact with the fill material, can be easily removed and re-used. The retainers may be used to interconnect, not only the panel members, but also the removable support members. Wire mesh may be disposed within the air gap to further enhance the structural integrity of the panel assembly, and also to enable a reduced thickness of the panel assembly.

One or more panel assemblies may be interconnected via a connecting assembly, which may comprise a U-shaped channel with one or more apertures formed thereon. The apertures are intended to allow a filler, such as concrete, to freely flow between adjacent air gaps of adjacently connected panel assemblies, reducing the need to incorporate concrete vibrators, but more importantly to provided effective interconnecting or tying together of the hardened adjacent structures. More specifically, a filler is intended to flow through the apertures between adjacent structural components of a building, such as for example, columns, beams, and/or walls. The apertures may also be used as templates for reinforcement members, which may go through the aperture between different air gaps of connected panel assemblies.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 10A is a top plan section view of one embodiment of an L-shaped channel according to the wall system of the present invention.

FIG. 13 is a front view of a removable support member according to one embodiment of the wall system according to the present invention.

FIG. 13A is a top plan section view of the embodiment of the removable support member represented in FIG. 13.

Like reference numerals refer to like parts throughout the several views of the drawings.

DETAILED DESCRIPTION OF THE PREFERRED EMBODIMENT

Figure 1:
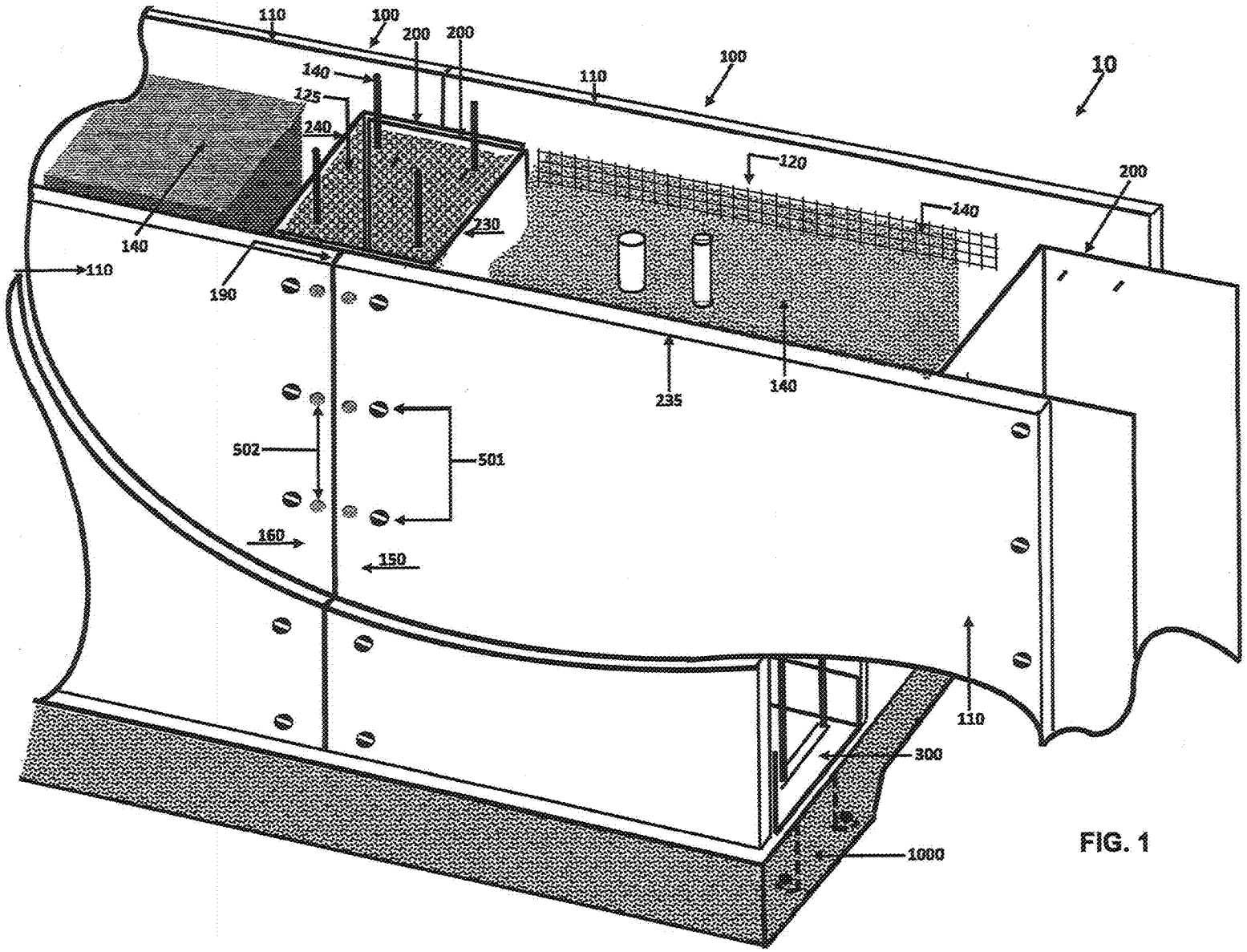
FIG. 1 is a perspective view (in partial cutaway) of a panel system in accordance with one embodiment of the present invention.

As illustrated in the Figures, the present invention is directed towards a wall system 10 that incorporates the use of one or more panel assemblies 100. The wall system 10 may be prefabricated, although this is not always required as it may also be quickly assembled on a job site. As seen in FIG. 1, the plurality of panel assemblies 100 are optimally to be interconnected, preferably at oppositely disposed longitudinal ends, via a plurality of connecting members 200. At least one of the plurality of connecting members 200 is disposed on each of the plurality of panel assemblies 100. In addition, each panel assembly 100 may include two panel members 110 interconnected via a plurality of connecting members 200, which may comprise substantially equivalent "U" shaped roll-formed steel structural channels. More specifically, the two panel members 110 of a panel assembly 100 may be disposed in spaced, connected relation, interconnected via a plurality of "U" shaped connecting members 200 disposed therebetween. In at least one embodiment, one of the two panel members 110 of a panel assembly 100 may define an exterior panel member 111, while the other of the two panel members 110 of the panel assembly 100 may define an interior panel member 112.

Figure 2:
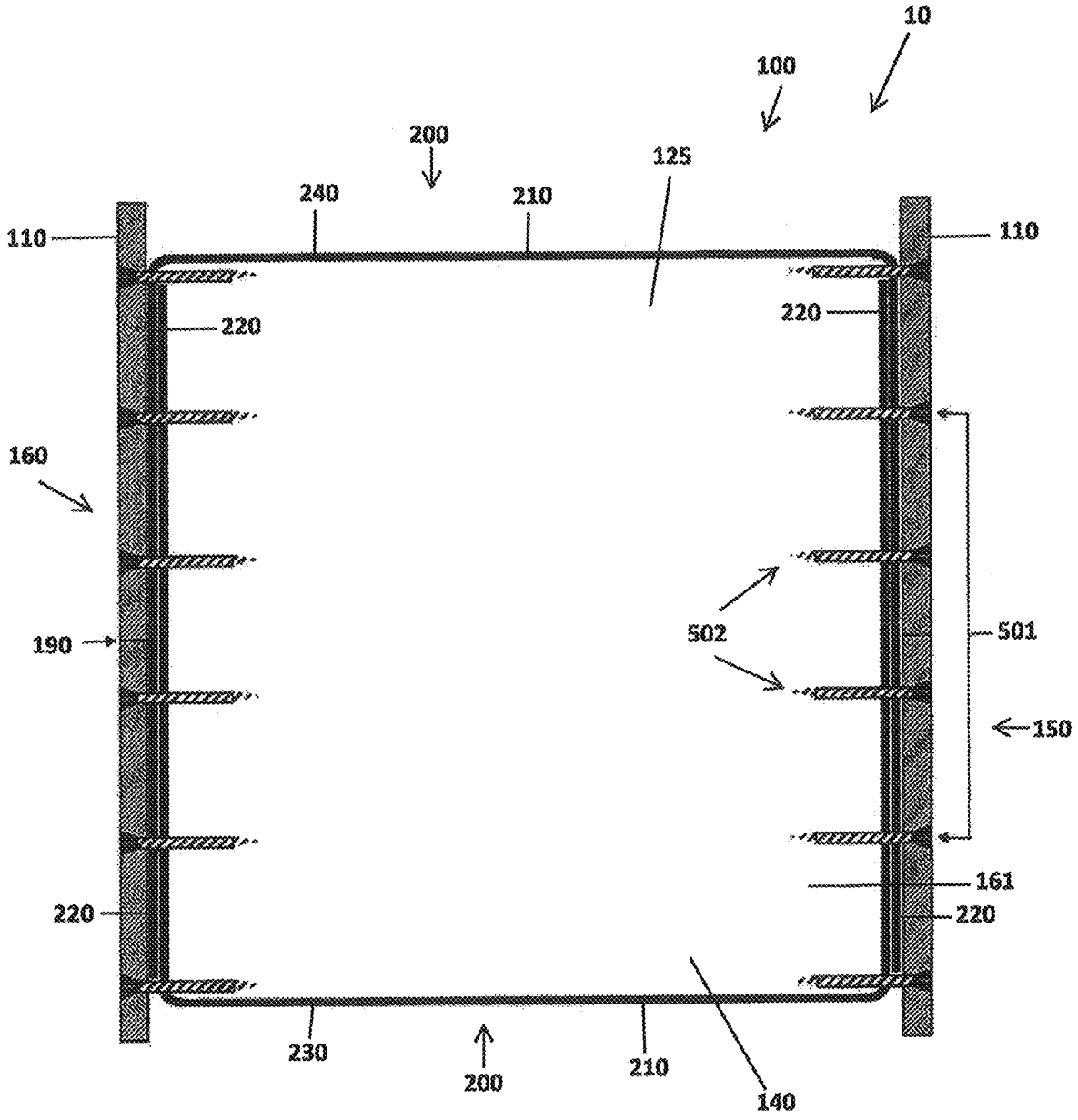
FIG. 2 is a top plan section view of a panel system in accordance with one embodiment of the present invention.

As illustrated in FIG. 2, at least one of the plurality of "U" shaped connecting members 200 of a panel assembly 100 may be disposed in a substantially 'tongue and groove' connecting relation with a correspondingly disposed "U" shaped connecting member 200 of another panel assembly 100. As such, the "U" shaped connecting member 200 of one panel assembly 100 may be disposed in a telescopic relation with the "U" shaped connecting member 200 of another panel assembly 100. More specifically, at least a portion of a "U" shaped connecting member 200 of one panel assembly 100 is disposable within at least a portion of a correspondingly disposed "U" shaped connecting member 200 of another panel assembly 100. This interconnection of two "U" shaped connecting members 200 of corresponding panel assemblies 100 may form a column configuration, as discussed in greater detail below.

In at least one embodiment, such as may be appreciated in FIGS. 1-2, each panel assembly 100 may comprise a male connecting end 150 and a female connecting end 160. The plurality of connecting members 200 may include a male connector 230 disposed on a male connecting end 150 and projecting outwardly therefrom a predetermined distance. Additionally, the plurality of connecting members 200 may include a female connector 240 disposed on a female connecting end 160 and recessed therefrom a corresponding predetermined distance. Moreover, a female connector 240 may comprise a recess 161 at a female connecting end 160. Further, at least some male connectors 230 may be disposed within the recess 191 of a correspondingly disposed female connector 240. Moreover, a male connector 230 of one panel assembly 100 may be disposed within a female connector 240 of another panel assembly 100 and securely retained thereto, such as with connectors of fasteners. More specifically, the male connector 230 of one panel assembly 100 may be disposed in a 'tongue and groove' connecting relation to the female connector 240 of another panel assembly 100.

The connecting members 200 may comprise "U" shaped roll-formed structural channels including a web 210 and two flanges 220, oppositely disposed on each end of the web 210. A connecting member 200 may be disposed on a male connecting end 150 of a panel assembly 100 with the web 210 projecting a predetermined distance therefrom in order to form a male connector 230. Accordingly, another connecting member 200 may be disposed on a female connecting end 160 of a panel assembly 100 with the web 210 recessed inwardly therefrom a predetermined distance in order to form a female connector 240. In one embodiment, at least one connecting member 200 may be disposed on the middle portion 235 of a panel assembly 100, between the male connecting end 150 and the female connecting end 160 of the panel assembly 100.

Further, as illustrated in FIGS. 1 and 2, the connecting members 200 may be securely attached to the panel assemblies 100 via a plurality of fasteners. More specifically, connecting member fasteners 501 may be disposed to primarily retain the connecting member(s) 200 in attached relation to the two panel members 110. When two panel assemblies 100 are to be securely interconnected, panel assembly adjoining fasteners 502 may be disposed accordingly to primarily retain adjoining panel assemblies 100 in attached relation to each other. In addition, the connecting member fasteners 501 and the panel assembly adjoining fasteners 502 may be disposed to secondarily enhance the strength of the panel assemblies 100.

The type of connecting member fastener 501 and/or panel assembly adjoining fastener 502 may vary depending upon the preferred or intended construction application. For example, connecting member fasteners 501, which may be configured for quick and/or automated installation, may be preferred such that the prefabrication of individual panel assemblies 100 may be facilitated. Accordingly, the two panel members 110 of a panel assembly 100 may be interconnected to a connecting member 200 via the connecting member fasteners 501 by the end-user prior to arriving at the construction site. As such, it may not be necessary that the connecting member fasteners 501 be removable, thus they can be configured to be permanently installed, which may enhance the strength of the panel assembly 100. Conversely, the panel assembly adjoining fasteners 502, which are configured for hand installation, may be preferred to facilitate connection by the end-user at the construction site. As such, it may be preferable to use removable panel assembly adjoining fasteners 502 such that the plurality of panel assemblies 100 may be connected and/or disconnected locally at the construction site.

As mentioned above, the two panel members 110 of a panel assembly 100 may be interconnected with a plurality of connecting members 200. In addition, the panel assemblies 100 may act as permanent "forms" that allow end-users to fill at least a portion of the panel assembly 100 with material at the construction site for added structural integrity. These "forms" may allow the end-user to quickly connect and fill the panel assemblies 100. As such, the panel assembly 100 includes an air gap 120 disposed between the two panel members 110, which filler material 140, such as, but not limited to concrete, fiber concreate, clay, slate, pellets, waste materials, may be disposed therein as desired for added strength. The panel assembly 100 may also comprise a variety of structural features that lend themselves to use in an exterior partition. For example, the panel members 110, specifically the exterior panel member 111, may be comprised of magnesium oxide board, phenolic fiberglass board, or wood strand board for increased strength and weather resistance.

As illustrated in FIGS. 1 and 2, panel assemblies 100 may be interconnected via a plurality of connecting members 200, disposed in a telescopically connected relation. In addition, this disposition of the male connector 230 within a corresponding female connector 240 may form a substantially column configuration. As such, this telescopic connection between the male connector 230 and the female connector 240 may comprise an air column 125. The air column 125 may be substantially disposed at a joint portion 190 of two interconnected panel assemblies 100 which may allow end-users to include filler material 140 such as concrete or the like therein at the construction site for added structural integrity. More specifically, the joint portion 190 may be formed by corresponding panel members 110 of adjoining panel assemblies 100.

An additional feature of the present invention comprises at least one air conduit disposed within the "formed" air column 125 that may allow end-users to include filler material 140 such as pre-set reinforcing steel rebar or the like therein at the construction site for enhanced strength. Thus, steel rebar may extend the width of the panel assembly and into an aperture of the base member 300. The reinforcing steel rebar are placed into an air conduit 125 and extend through the base member 300 aperture to allow concrete to be placed after this pre-set construction is completed. As such, the steel rebar may be connected to the concrete slab 1000 for additional support to the structure. In another embodiment, the steel rebar may extend and be disposed within the structural channel of the base member 300, but not necessarily through an aperture thereof. For example, a steel dowel may (e.g., #5 dowel) be connected and extend up from the concrete slab 1000 through an aperture of the base member 300 and be tied to a steel rebar for additional support to the structure.

As illustrated in FIG. 2, a recess 161 of the female connector 240 of one panel assembly 100 into which the male connector 230 of another panel assembly 100 is inserted is more clearly depicted. The recess 161 is formed by recessing a female connector 240 a predetermined distance inwardly from a female connecting end 160 of a panel assembly 100. At least a portion of the male connector 230 of one panel assembly 100 may be disposed in a telescopic connected relation within at least a portion of the female connector 240 of another panel assembly 100. More specifically, the corresponding flanges 220 of the male connector 230 of one panel assembly 100 may be disposed within the female connector 240 of another panel assembly 100.

As such, the corresponding flanges 220 of the male connector 230 may be inserted into the corresponding female connector 240. As such, the air column 125 is formed between the two adjoined connecting members 200. This may enhance the strength of the panel assemblies 100 twofold. Moreover, the strength of at least the exterior panel member 111, which may be the critical side of exterior panel assemblies 100 exposed to the wind, is increased by double.

As mentioned above, and illustrated in FIG. 2, the corresponding flanges 220 of the male connector 230 may be at least partially disposed within at least a portion of the female connector 240 by the end-user. Such method of connection may enhance the strength of the two panel members 110 of a panel assembly 100 by double, specifically at the joint portion 190 of interconnected panel assemblies 100, as discussed above. It will be appreciated by those skilled in the art that in embodiments where such method of connection is preferable, at least the male connector 230, and specifically the corresponding flanges 220 thereof, should be constructed of such material as to exhibit substantially strong but flexible qualities, such as but not limited to steel.

In certain embodiments, it may be desirable to cooperatively dimension the depth of the recess 161 of the female connector 240 with the length of projection of the corresponding flanges 220 of the male connector 230 such that the male connector 230 and female connector 240 effectively connect when corresponding panel assemblies 100 are adjoined. Thusly disposed, the interconnected male connector 230 and female connector 240 comprise the air column 125, which serves to increase the overall strength of the present invention, and specifically increases the bending stiffness at the joint portion 190 of the interconnected panel assemblies 100. For example, the female connector 240 being disposed substantially across the joint portion 190, provides added strength and a measure of resistance to fluid flow therethrough.

Further, in one embodiment, the exterior panel member 111 of a panel assembly 100 may be intended to face an exterior of the structure; the interior panel member 112 of the panel assembly 100 may be intended to face an interior of the structure. As such, drywall or the like may be affixed where desired on the interior panel member 112, and an exterior treatment, such as stucco or another finish, may be applied where desired to the exterior panel member 111. Such an exterior treatment may increase the strength and weather resistance of the panel assembly 100.

Figures 3, 3A:
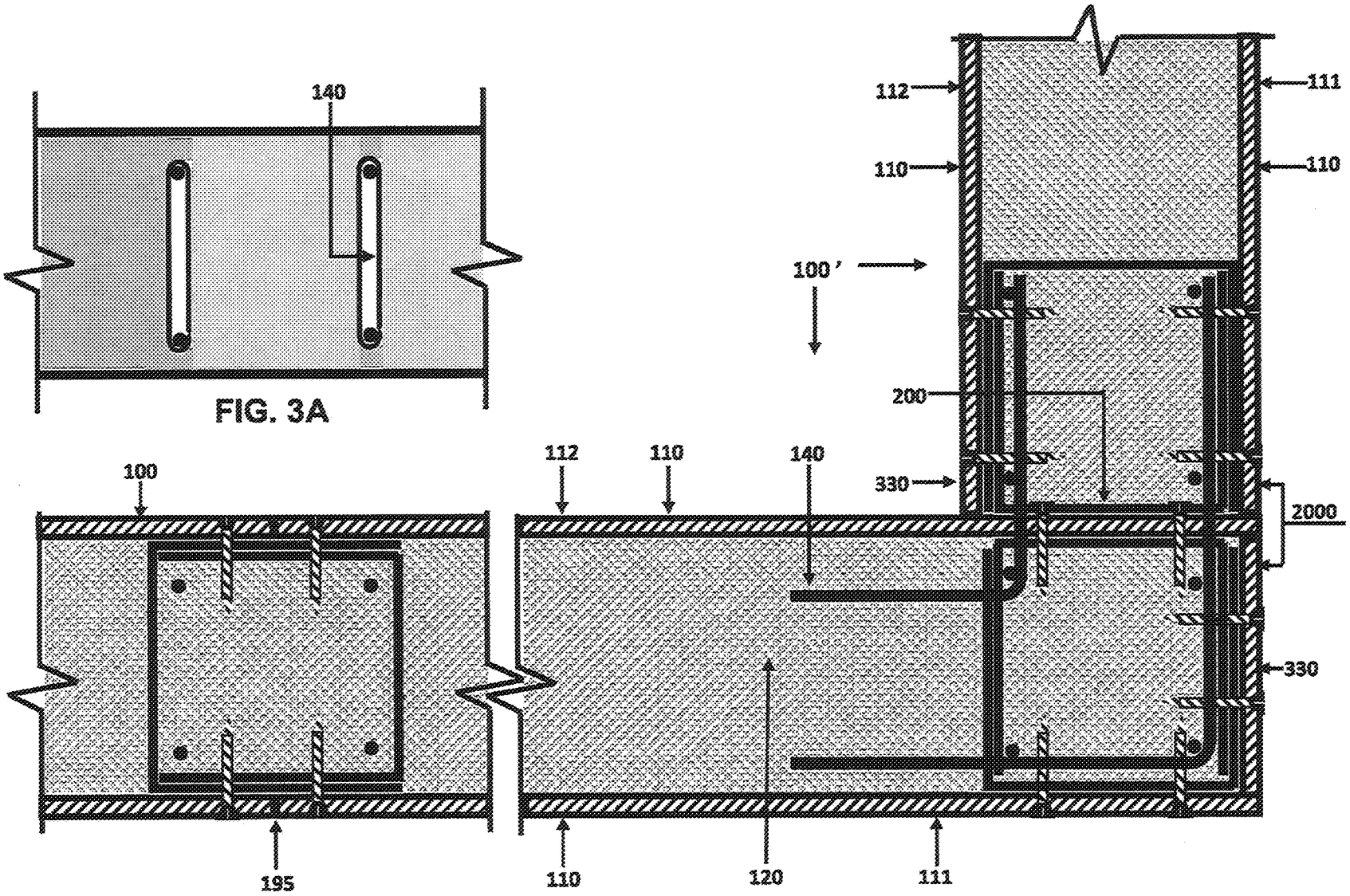
FIG. 3 is a top plan section view (in partial cutaway) of a panel system in accordance with one embodiment of the present invention.
FIG. 3A is a front view of a portion of a panel system in accordance with one embodiment of the present invention.

As illustrated in FIG. 3, a plurality of panel assemblies 100 and a corner assembly 2000 are depicted. Further, an end panel assembly 100' may be used, for example, to construct a corner of the structure. Accordingly, a panel assembly 100 may be disposed in interconnecting relation with an end panel assembly 100'. An end panel assembly 100' may be defined coextensively with interconnected "U" shaped male and female connecting members 230, 240 disposed at an end portion 330 of the end panel assembly 100'. Additionally, the end panel assembly 100' may be disposed in a corner assembly 2000 with another end panel assembly 100', in angled relation.

As illustrated in FIG. 3, a corner assembly 2000 may comprise an end panel assembly 100' interconnected in an angled relation to another end panel assembly 100'. To enhance the structural stability of the corner assembly 2000 any of a variety of support structures may be utilized, such as angled or "L" shaped rebar corner bars, to interconnect both end panel assemblies 100' of the corner assembly 2000. To facilitate the insertion of the "L" shaped rebar from one end panel assembly 100' to the other end panel assembly 100' of the corner assembly 2000, the steel "U" shaped male and female connectors 230, 240 of the end panel assemblies 100' of the corner assembly 2000 will have at least one corresponding slot or aperture as illustrated in FIG. 3A.

More specifically, the male and female connectors 230, 240 of the end panel assemblies 100' may comprise a plurality of corresponding apertures along an exterior surface thereof. Such apertures may be drilled, cut, or otherwise formed at the jobsite, or alternatively may be provided with pre-punched apertures. Such apertures may provide a recess into which angled rebar can be passed therethrough allowing for additional support to the structure.

Figure 4:
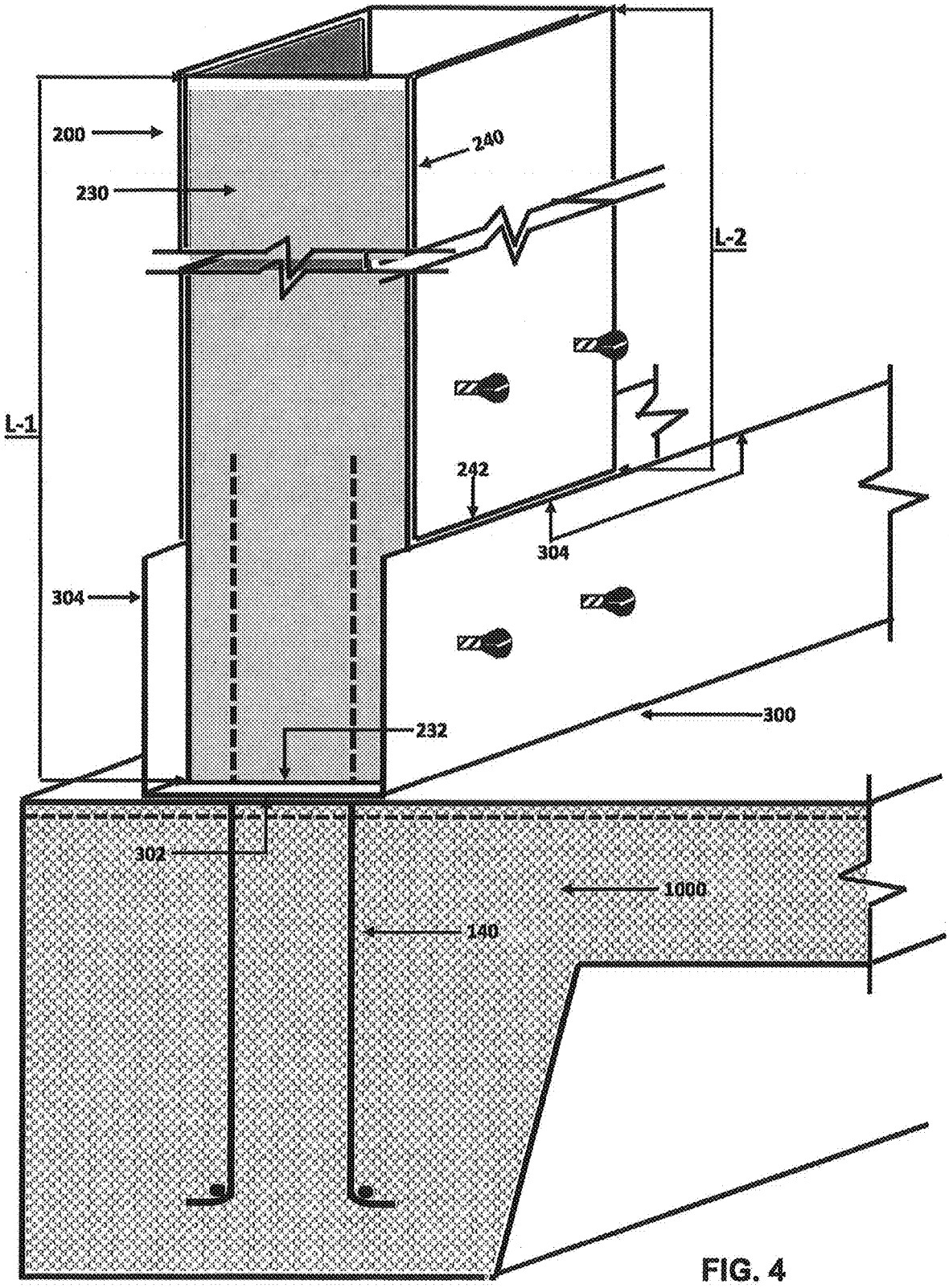
FIG. 4 is a perspective view of a portion of a panel system in accordance with one embodiment of the present invention comprising a male connector having a longer length than a female connector.

With reference now to FIG. 4, additional features of the present invention comprise providing a male connector 230 and a female connector 240 comprising different lengths. The panel system 10 may comprise a base member 300 disposed along a floor structure, such as a concrete slab 1000, in interconnected relation between the concrete slab 1000 and at least a portion of the connecting members 200 of the panel assemblies 100, as discussed in greater detail below. As such, a plurality of panel assemblies 100 may be disposed in interconnected relation along a concrete slab 1000. The base member 300 may comprise an elongated structural channel longitudinally disposed between interconnected panel members 110 of the plurality of panel assemblies 100. Further, the base member 300 may comprise a "U" shaped open-ended structural channel into which at least a portion of the connecting members 200 is disposable. The end or lowermost portion of the connecting members 200 may be disposed within the channel of the base member 300. For example, the base member 300 may comprise a base portion 302 and one or more lateral portions 304. In one embodiment, an end portion 232 of the male connector 230 may be disposed within the base member 300, such as in abutting relation to the base portion 302 of the base member 300. An end portion 242 of the female connector 240 may be disposed in abutting relation with a portion of the base member 300, such as the lateral portions 304. In at least one embodiment, the flanges 220 of the female connector 240 may be disposed in abutting relation to a corresponding lateral portion 304 of the base member 300. In at least one embodiment, the flanges 220 of the male connector 230 may be disposed in abutting relation to at least a portion of the base portion 302 of the base member. As may be appreciated from the illustrative embodiment of FIG. 4, a length L1 of the male connector 230 may be longer than a length L2 of the female connector.

The base member 300 may comprise a plurality of apertures along an exterior surface of the base member 300 and particularly along an exterior surface to be disposed adjoining the concrete slab 1000 upon which the present invention is to be deployed. Such apertures may be drilled, cut, or otherwise formed at the jobsite, or alternatively, a base member 300 may be provided with pre-punched apertures. Such apertures may provide a recess into which filler, such as a steel dowel or rebar can be passed therethrough to the concrete slab 100 allowing for additional support to the structure. As depicted FIG. 1, the base member 300 may be disposed between interconnected panel members 110.

In another embodiment, not shown for clarity, a plurality of panel assemblies 100 may be disposed in interconnected relation to a ceiling of the structure. More specifically, the plurality of panel assemblies 100 may include a support member to which trusses and/or roof beams may be fastened. Further, a horizontal support beam may be disposed coextensively with the support member to reinforce the attachment point of the roof beams and/or trusses. The horizontal support beam may comprise pressure treated lumber or the like.

With reference to FIGS. 5-16, other embodiments according to the present invention relate to a wall system including a panel assembly 100' which can, if desired, include a reduced overall wall thickness while still providing the needed structural integrity, but nevertheless, provides for more rapid and efficient use and integration into a structure. The panel assembly 100' may be pre-fabricated, but this is not strictly necessary as it may also be efficiently assembled on a jobsite site. Accordingly, the inventive panel assembly 100' may comprise a variety of components that may be manufactured in a controlled environment, allowing for an efficient and cost effective jobsite installation. The inventive panel assembly 100' also facilitates quality control during installation. More specifically, the inventive panel assembly 100' may comprise a combination of panel members 100' with retainers 180 that can be temporary in nature and are intended to temporarily bolster the structural rigidity of the panel assembly 100'. As will be explained hereinafter, the present invention may incorporate a plurality of panel assemblies 100' with various advantageous features that permit an efficient construction and installation of a variety of components of structures including, without limitation, homes, town homes, urgent care facilities, schools, etc.

Figure 12:
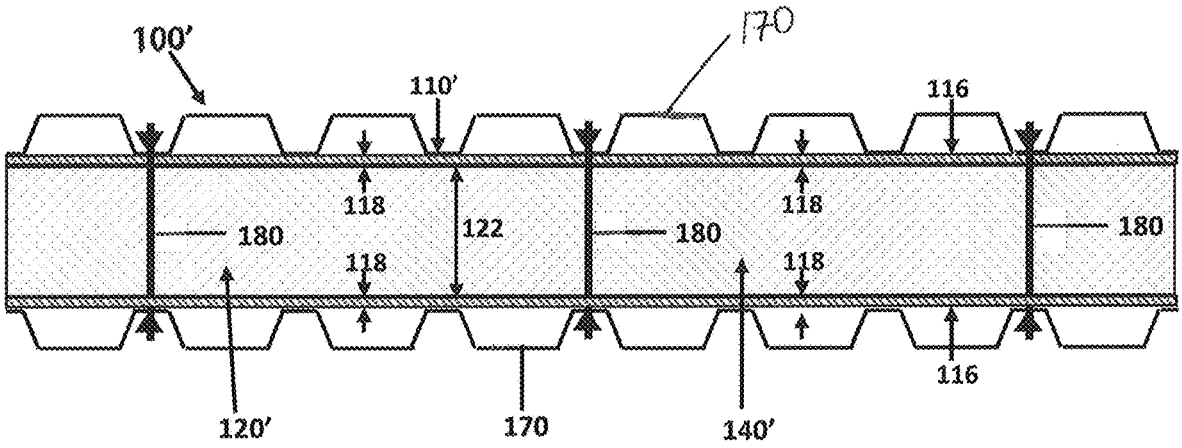
FIG. 12 is a top plan section view of a portion of one embodiment of the present wall system that incorporates the use of the panel assemblies in conjunction with removable support members.

As is shown at least in FIG. 12, the panel assembly 100' according to the present invention generally comprises two panel members 110'. The panel members 110' are generally disposed in a spaced, interconnecting relation, collectively defining an air gap 120'. It is within the scope of the present invention that a filler 140' be placed within the air gap 120' to create a portion of a building structure, e.g., an interior or exterior wall. It is further within the scope of the present invention that the panel members 110' act as forming support to the filler 140', and further, that they not be removed. Instead, the panel members 110' are intended to remain in place as a permanent component of the building structure that achieve a finished appearance without the need for additional surfacing and provide added strength beyond what would be achieved by a conventional molded wall of the same thickness. As is shown at least in the illustrative embodiment of FIG. 12, each panel member 110' comprises an inside face 114 and an outside face 116. Generally, the spaced relation of the panel members 110' defines an air gap 120' with a predetermined thickness 122. As will be described hereinafter, various features described herein enable a reduced thickness 122 of the air gap 120' if desired, and consequently a reduced thickness of the resulting component of the building structure, which will also include the filler 140'. For example, the thickness 122 of the air gap 120' may be about 4 inches, or less, for exterior and/or interior walls of houses, town homes, or other related building structures. It is within the scope of the present invention that such interior walls be structural walls, but this is not always necessary. In at least one embodiment, interior building walls may be provided with conventional materials, e.g., drywall. In at least one embodiment, the thickness 122 of the air gap 120' may be about 3.5 inches. Such a reduced thickness 122 of about 4 inches, or less, is also advantageous as it permits easier handling of the panel members 110', which are generally stronger than with other traditional construction methods. Further, such a reduced thickness reduces the overall costs of construction. As a further example, the thickness 122 of the air gap 120' may be about 6 inches for other applications, including multi-story or high-rise buildings, and wind-resistant shear walls. As an even further example, the panel assembly 100' may also preferably be used as an exterior concrete wall, or as an interior partition wall that may also provide insulation between different regions of a building.

The inside faces 114 of the two panel members 110' will generally face towards one another, and will later be in contact with, and will provide support to the filler 140'. The filler 140' may comprise a combination of different materials, such as for example suitable concrete mixtures. For example, the filler 140' may comprise lighter or lightweight concrete, or a related material, or traditional concrete formulas. For example, the filler 140' may comprise lightweight concrete, slate, volcano compounds, and other suitable materials. Lighter concrete, if used, is advantageous when used in connected with an air gap 120' having a reduced thickness 122 as it may flow more effectively through different areas of the air gap(s) 120', and with lesser air bubbles, which may otherwise develop during casting operations. As used herein, the term "casting" refers to the process of placing a filler 140', e.g., concrete, within the air gap(s) 120' defined by the two panel members 110' of the inventive panel assembly 100'. Lighter concrete provides the advantage of filling certain areas of the air gap(s) 120' more efficiently, for example, at the corners, and or at lower portions of the air gap(s) 120'. Lighter concrete also reduces the need to use vibrators during casting operations. Of course, it is nevertheless understood that standard concrete can be equivalently used with the novel structure of the present system, and may in fact be desirable in certain applications.

It is also within the scope of the present invention that the panel member 110' comprise other advantageous features that may contribute to a reduced overall thickness, added strength, faster construction and pre-finished exterior of an intended component of a building structure. For example, the panel member 110' may comprise a material that provides added structural support and/or that may reduce longitudinal deflections of the panel members 110', such as along their width W1. The material of the panel members 110' may also be at least partially resistant to a liquid filler 140', such as, but not limited to, concrete. That is, the panel members 110' should reduce absorption of moisture from the filler 140' to effectively function as permanent forms that will be a part of the building structure. This provides enhanced structural properties, including of portions of the building which act as shear walls once the filler material 140' dries and gains sufficient structural strength. Such shear walls may be used to protect the building structure from lateral loads such as may be associated with wind, hurricanes, or earthquakes. When used as a shear wall, the panel assembly 110' may be provided with suitable structural components, such as wire mesh, and may be interconnected to roof trusses, concrete slabs, or to foundation dowels, including, but not limited to, No. 5 structural steel dowel bars.

As a non-limiting example, the material of at least one of the panel members 110' may include fiber cement. In a preferred embodiment the material of both panel members 110' of a panel assembly 100' may also comprise fiber cement. The panel members 110' may include, but are not necessarily limited to one or more of the following: magnesium sulfate, magnesium oxide, wall panels, sandwich panels, and other materials with a suitable modulus of elasticity, bending and/or tensile properties, and/or compressive strength, which may at least partially reduce bowing, buckling, or deflecting. The material of the panel members 110' may further allow for a reduced panel thickness 118. Such a reduced thickness 118 may vary, but in at least one embodiment is about 6 millimeters. Additionally, and as mentioned above, each panel member 110' comprises an inside face 114, as well as an outside face 116. The outside face 116 of at least one panel member 110' of an assembly 100' may be disposed on an outside of a building structure, such that it is in direct contact with the outside environment. Accordingly, the outside face 116 of one or more panel members 110' may comprise a coating or other material that may protect the panel assemblies, and consequently the inside of the building, from ambient conditions. Such coating or other suitable material may be provided as a substitute to stucco, which is a commonly used product to protect the inside of the building structure from ambient conditions, for example, moisture. Further, because of the uniform, finished appearance of the outside face 116, additional surfacing may not be required.

As mentioned above, and with reference to at least FIG. 12, the wall system according to the present invention may comprise a removable support member(s) 170. The wall system according to the present invention may comprise one or more removable support member(s) 170. This generally eliminates the need to incorporate panels 110' with an increased thickness 118, as would otherwise be needed to lower buckling, bowing, and/or deflections of the panels 110'. Accordingly, one or more removable support members 170 may be disposed on the outside face 116 of a panel member 110'. A removable support member 170 may be temporarily attached or otherwise disposed on the outside face 116 of a corresponding panel member 110' to further provide structural stability and to at least partially reduce bowing of the panel members 110', that is, vertical and/or horizontal deflections of the surface of the panel member 110' due to the weight of the filler 140'. It is within the scope of the present invention that the removable support member(s) 170 be disposed on the panel members 110' via a plurality of retainers, indicated as 180. Further, the retainers 180 may also be used to interconnect the two panel members 110' of the panel assembly 100'. As a non-limiting example, the retainers 180 may comprise snap-ties, or similar retaining mechanisms that are temporary in nature and may be removed after casting of the filler 140'. The removable support member(s) 170 are intended as a temporary structure that will be removed from the panel members 110' after the filler 140', e.g. concrete, has cured and gained sufficient strength.

Figure 13B:
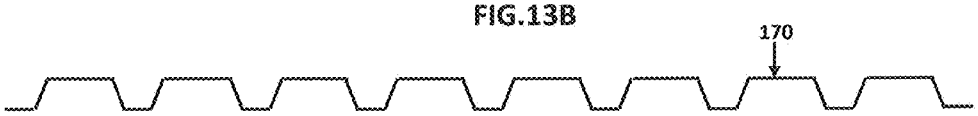
FIG. 13B is a top plan section view of a portion of a removable support member in accordance with another embodiment of the panel system according to the present invention.
Figure 13D:
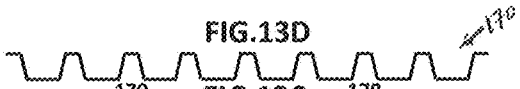
FIG. 13D is a top plan section view of a portion of the removable support member represented in FIG. 13C.
Figure 13C:
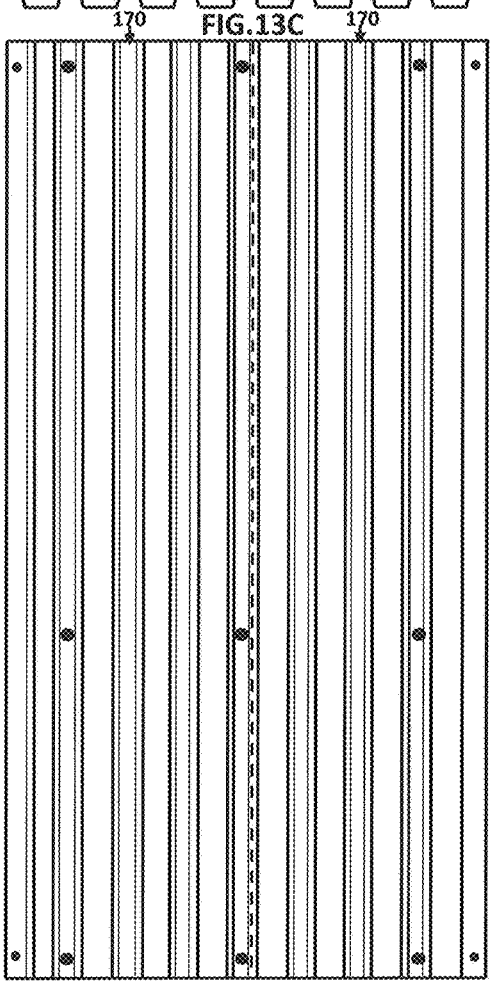
FIG. 13C is a front view of a removable support member according to another embodiment of the wall system according to the present invention.
Figure 13F:
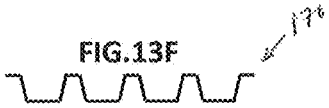
FIG. 13F is a top plan section view of a portion of the removable support member represented in FIG. 13E.
Figure 13E:
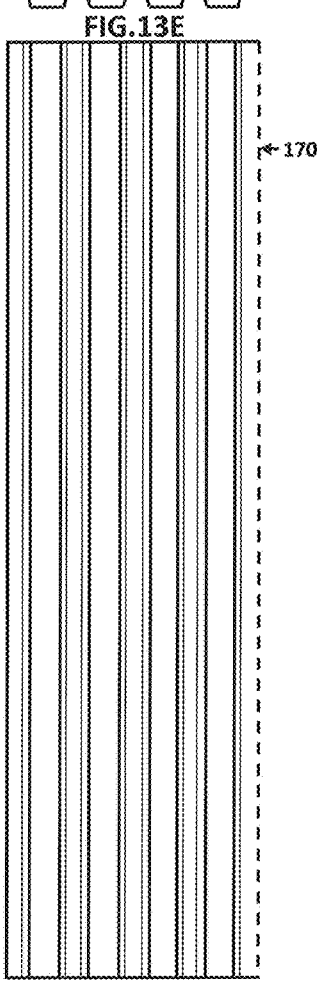
FIG. 13E is a front view of a removable support member according to yet another embodiment of the wall system according to the present invention.
Figure 13H:
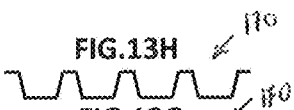
FIG. 13H is a top plan section view of a portion of the removable support member represented in FIG. 13G.
Figure 13G:
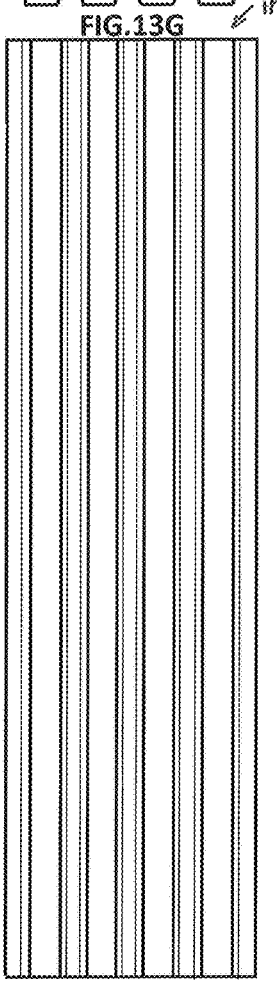
FIG. 13G is a front view of a removable support member according to a further embodiment of the wall system according to the present invention.
Figure 13J:
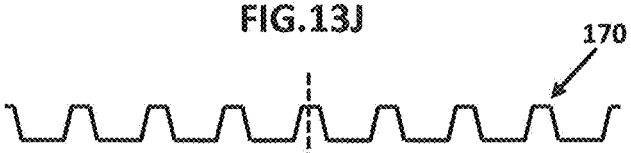
FIG. 13J is a top plan section view of a portion of the removable support member according to an even further embodiment of the present invention.
Figure 13I:
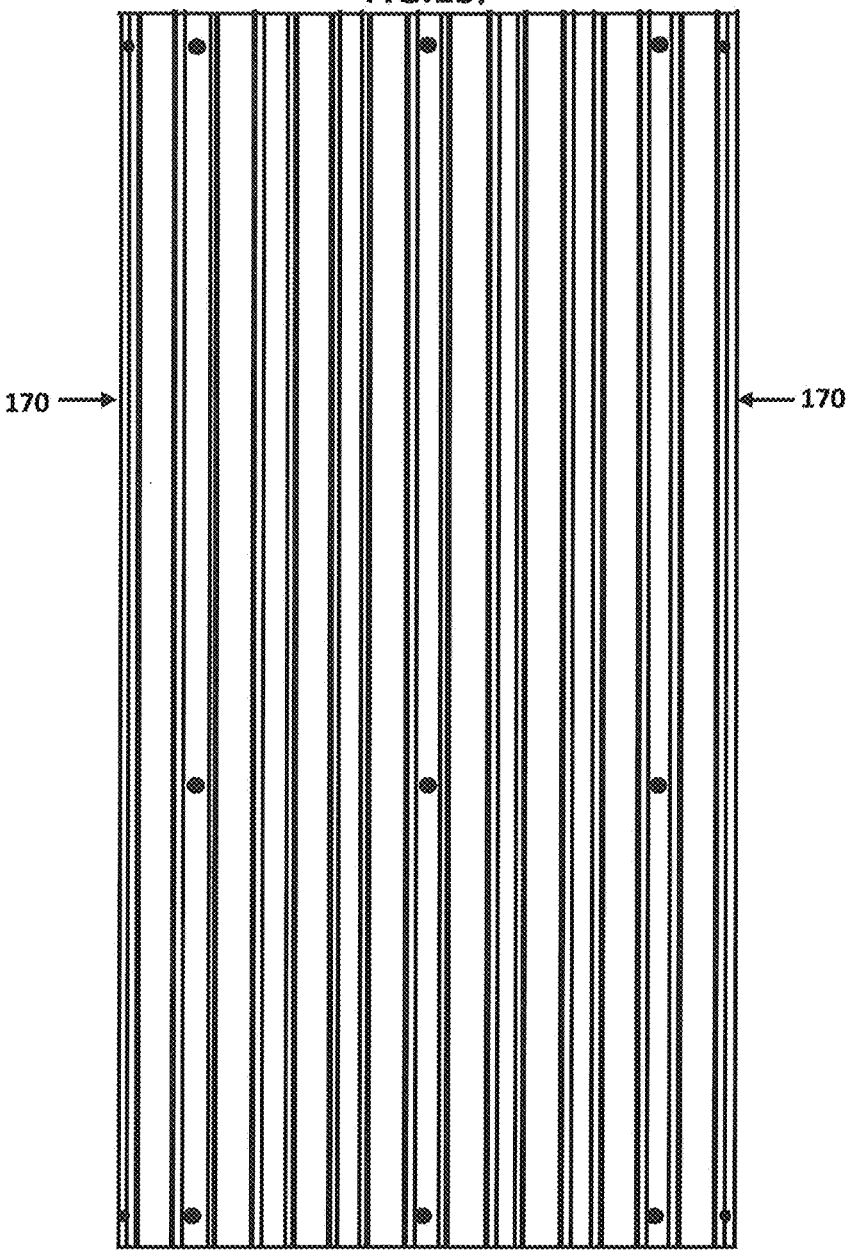
FIG. 13I is a front view of the removable support member represented in FIG. 13J.

The removable support member(s) 170 may comprise a variety of structural components. For example, at least one, and in some embodiments both, removable support member(s) 170 of a panel assembly 100' may comprise corrugated steel panels. Illustrative examples of various removable support members 170 are shown in FIGS. 13-13K. Further examples of removable support members 170 that may be used in connection with the inventive panel assembly 100' include roofing and decking steel forms. Such removable support members 170 also provide the advantage of not having to incorporate vertical and/or horizontal postings, which may be labor intensive and which may add to the overall associated construction costs. The removable support members 170 may be provided in varying widths, which is indicated as a second predetermined width W2 in FIG. 13. To facilitate installation, however, the removable support members 170 may comprise a width W2 of about 2 feet, such that a plurality of removable support members may be adjacently disposed to one another in an overlapping arrangement on the outside face 116 of a panel(s) 110' to provide the needed strength while still providing for easier and more rapid use and manipulation of the support members 170. In at least one embodiment, the first predetermined width W1 of a panel member 110' is greater than the second predetermined width W2 of a correspondingly disposed removable support member 170. In such embodiments, more than one removable support member 170 may be disposed on the outside face 116 of a corresponding panel member 110' in overlapping relation, also taking advantage of the retainers 180 to interlock overlapping support members 170.

Figure 9:
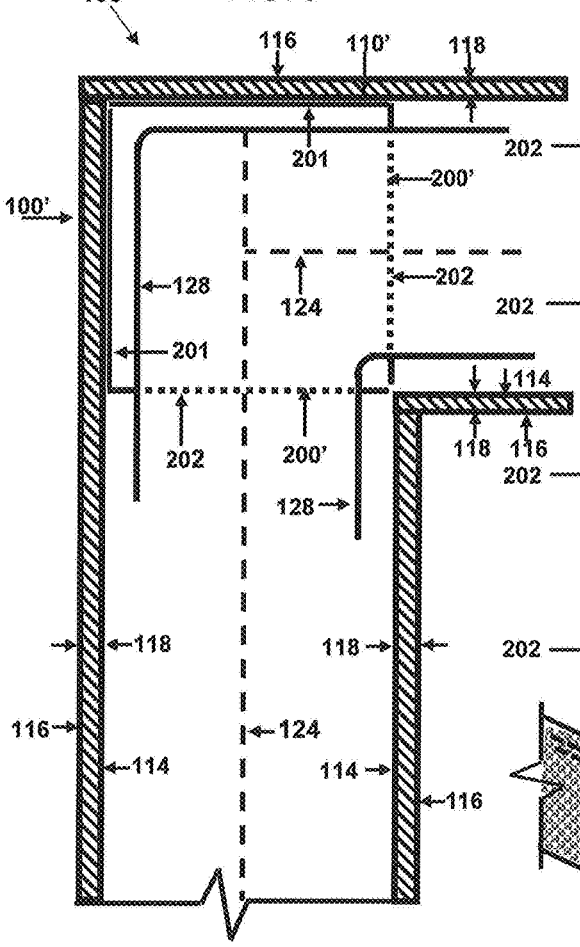
FIG. 9 is a top plan section view of a panel assembly of the wall system in accordance with one embodiment of the present invention.
Figure 10:
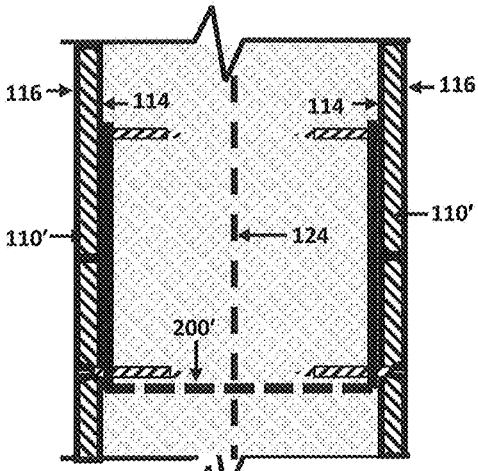
FIG. 10 is a top plan section view of a panel assembly of the wall system in accordance with another embodiment of the present invention.
Figure 11:
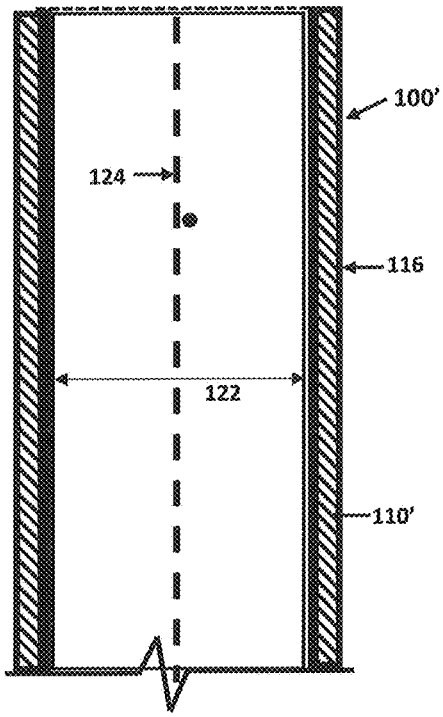
FIG. 11 is a side section view of a portion of a panel assembly of the wall system in accordance with another embodiment according to the present invention.
Figure 11:
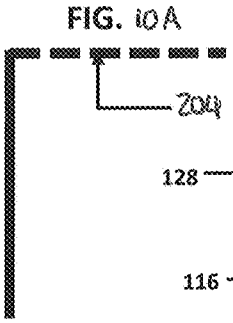
Figure 11:
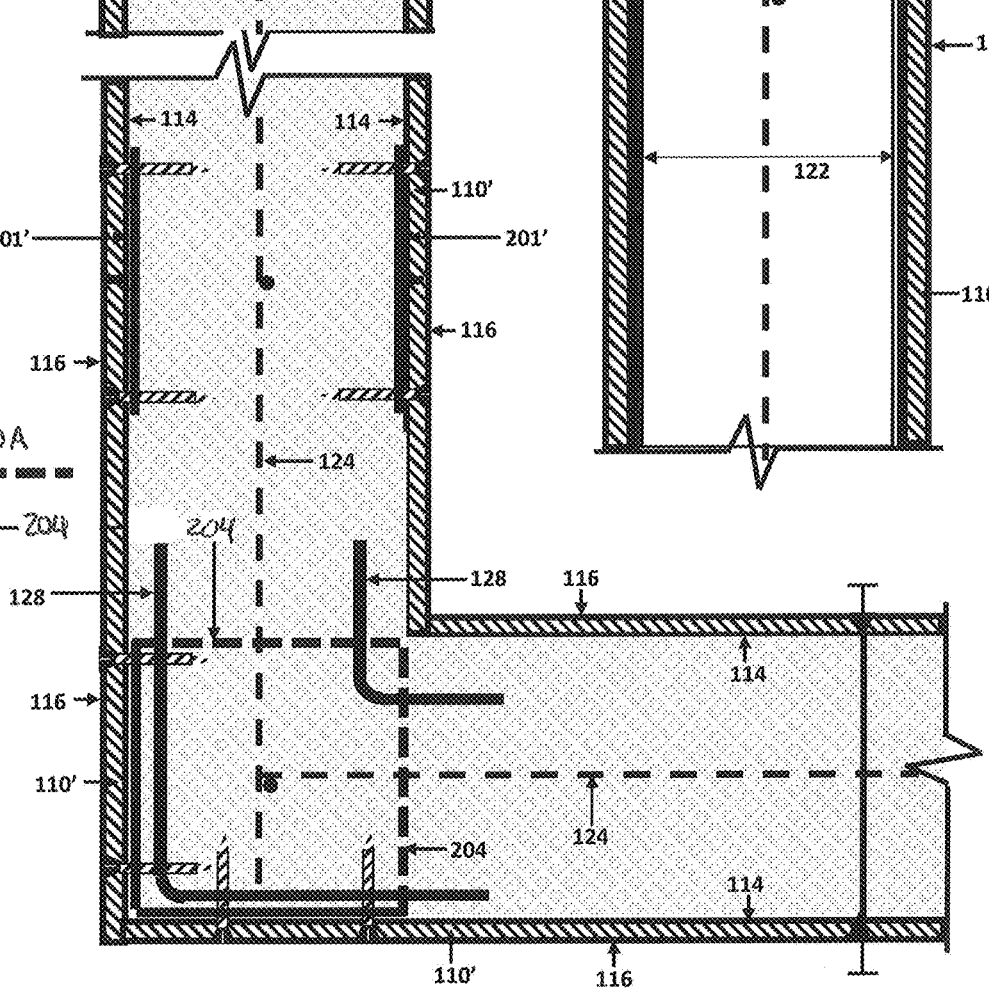

As is generally shown at least in FIGS. 6, 7-7B and 9-11, further features of the wall system according to the present invention comprise a wire mesh layer 124 disposed with the air gap 120'. The wire mesh layer 124 is intended to provide enhanced structural support to the panel assembly 100' so as to reduce the need to incorporate columns, or other structural components, along the span of the panel assembly 100'. For example, in at least some embodiments a wire mesh layer 124 may provide sufficient reinforcement at a corner column such that structural steel angles may not be necessary. Corner columns, however may be incorporated according to specific field conditions, design parameters, etc. For example, FIG. 10 shows an illustrative embodiment of corner columns that incorporate one or more connecting assemblies 200' in the form of L-shaped structural channels. In some embodiments, structural U-channels are not provided at a corner column(s), but instead two adjacently disposed "inverted" structural L-channels may be provided a corner column(s). In other embodiments, for example as represented in at least FIGS. 5-5A and 8, one or more connecting assemblies 200' may also be provided comprising structural U-channels. At corner columns however, it may be sufficient to simply incorporate a wire mesh layer(s) 124, in lieu of providing a connecting assembly 200', as will be explained hereinafter.

Figure 5:
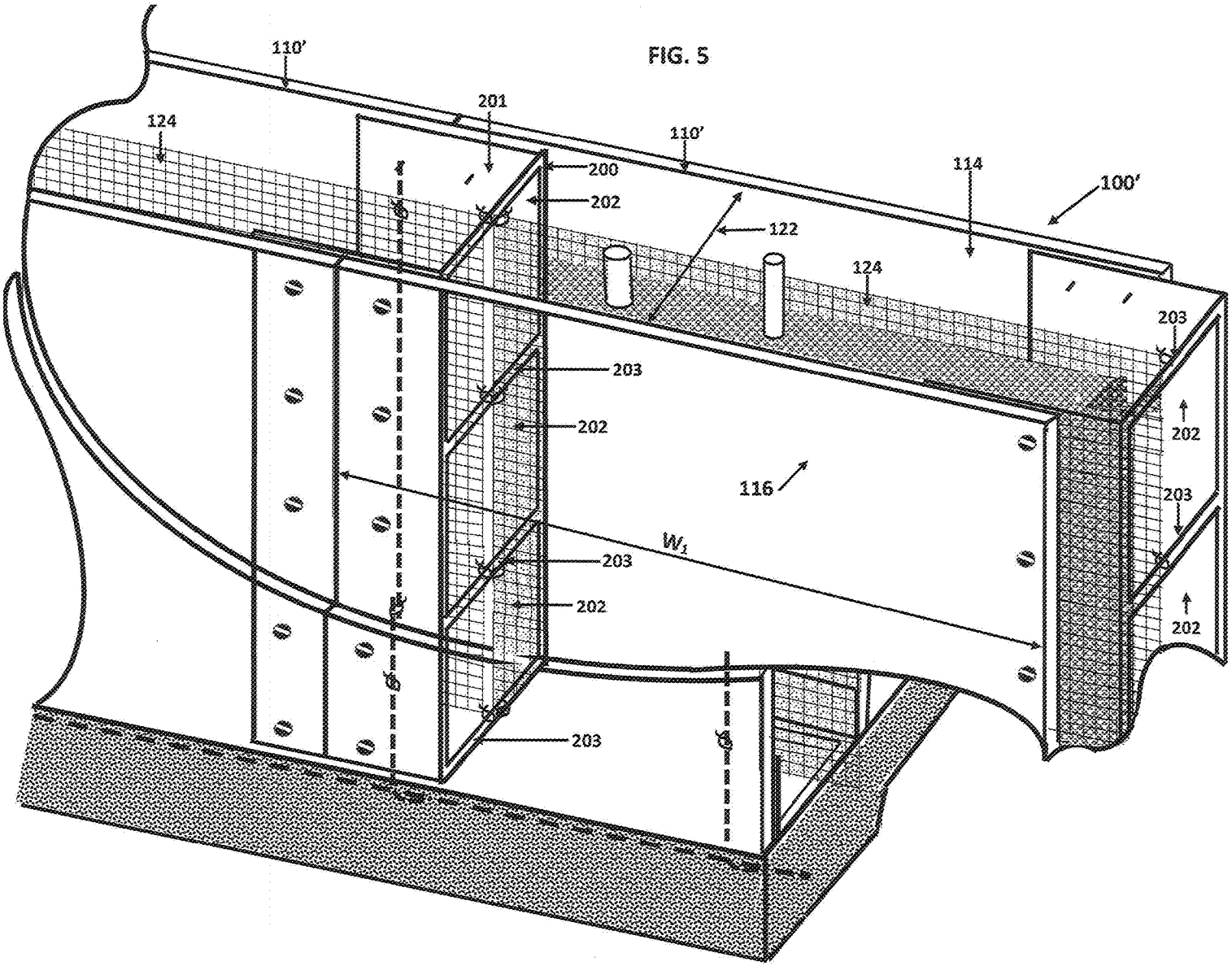
FIG. 5 is a perspective view (in partial cutaway) of a panel assembly of the wall system in accordance with one embodiment of the present invention.
Figure 5A:
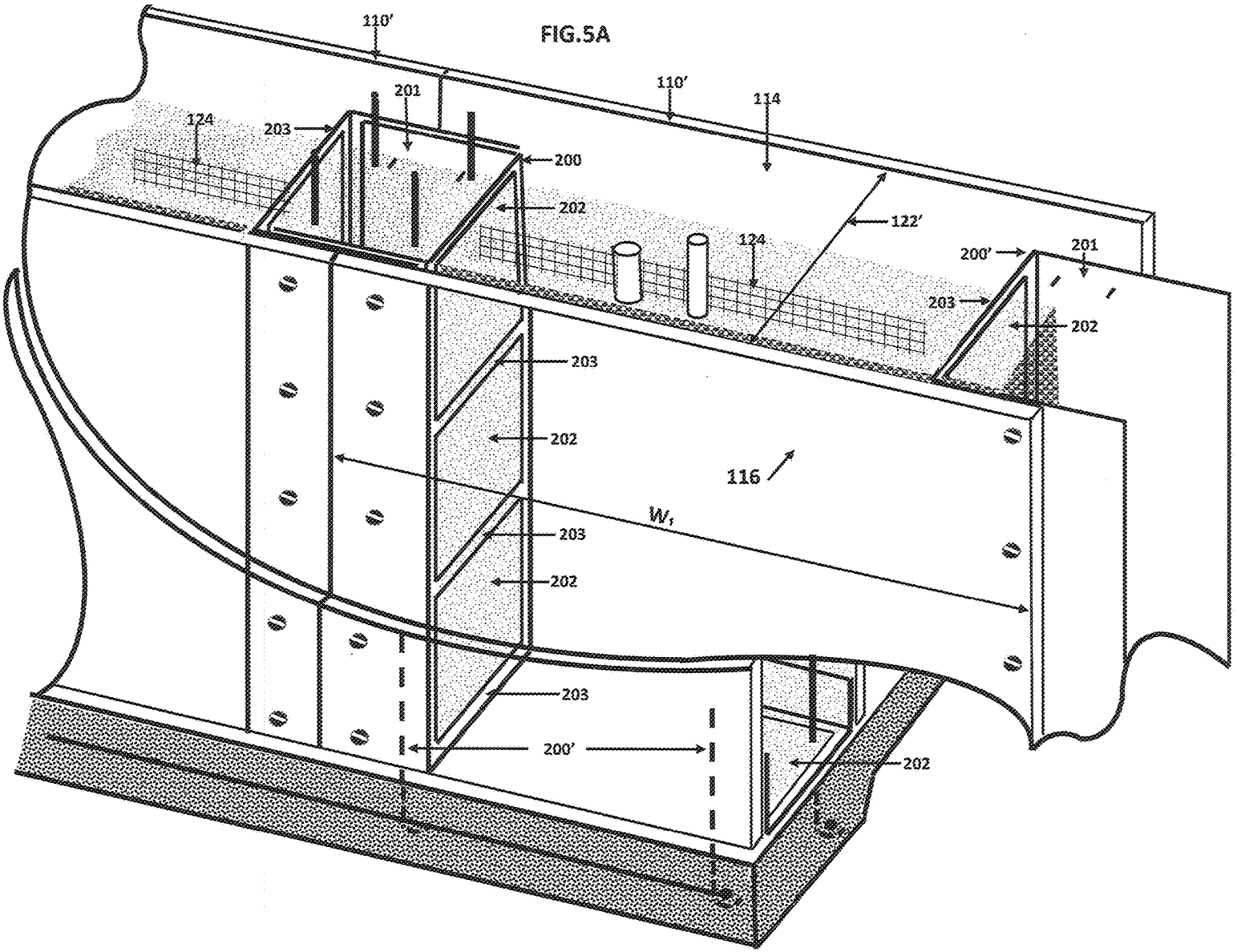
FIG. 5A is a perspective view (in partial cutaway) of a panel assembly of the wall system in accordance with another embodiment of the present invention.
Figure 6:
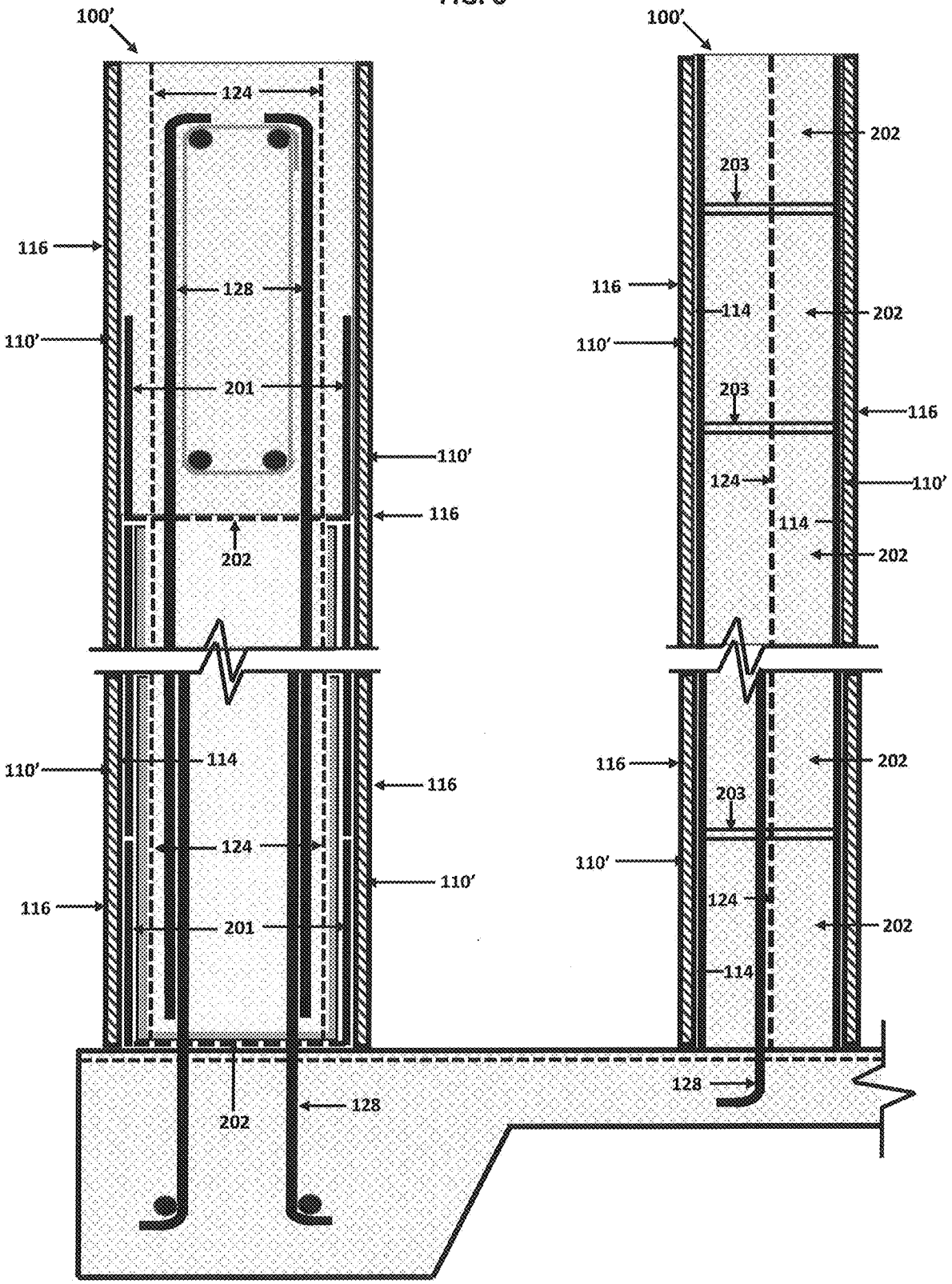
FIG. 6 is a side section view of a portion one embodiment of a wall system in accordance with the present invention comprising two panel assemblies.
Figure 7:
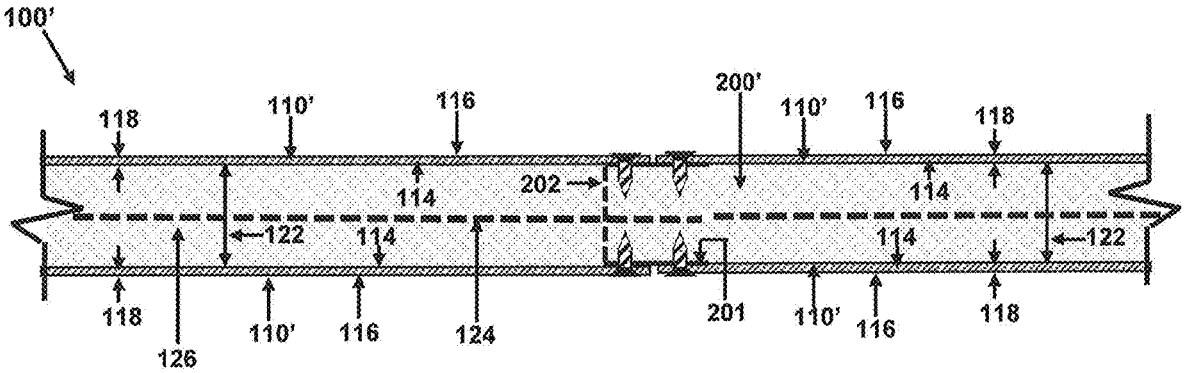
FIG. 7 is a top plan section view of a portion of a panel assembly of the wall system in accordance with one embodiment of the present invention comprising a connecting assembly.
Figure 7A:
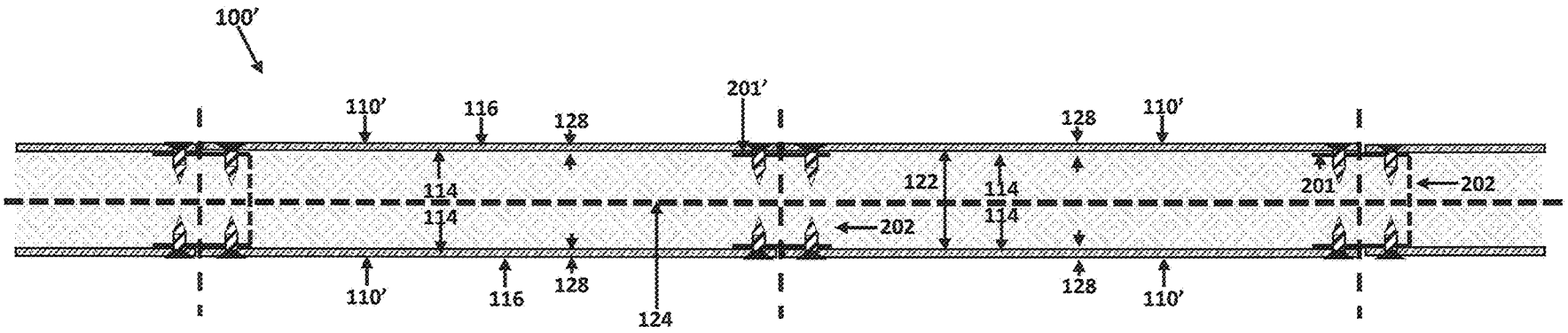
FIG. 7A is a top plan section view of a portion of a panel assembly of the wall system in accordance with another embodiment of the present invention comprising a three connecting assemblies.
Figure 7B:
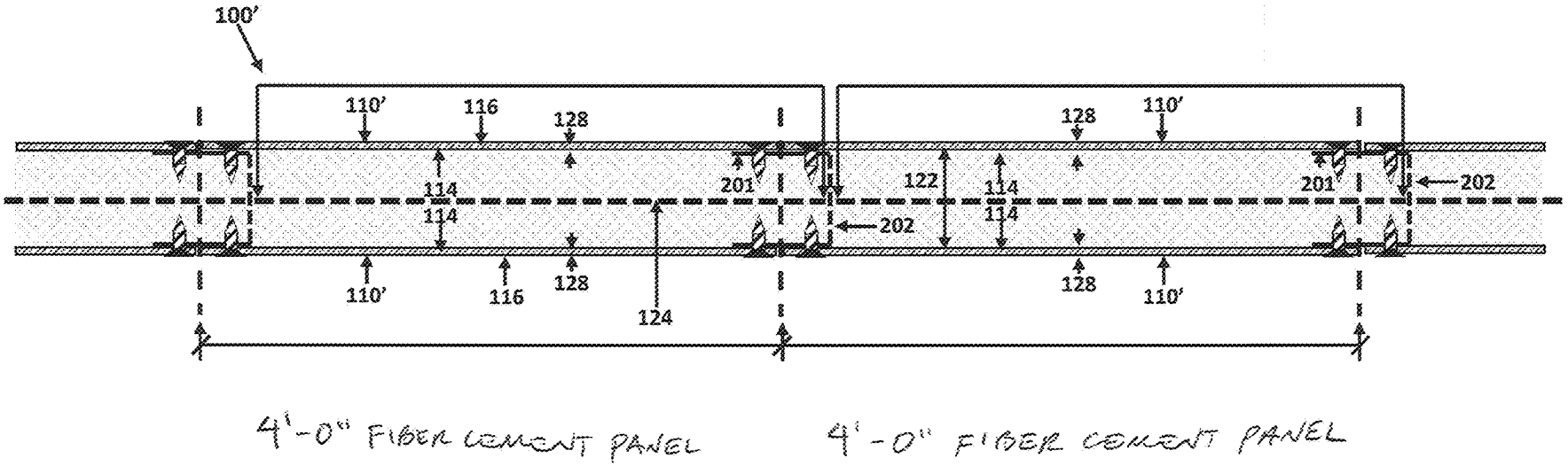
FIG. 7B is a top plan section view of a portion of a panel assembly of the wall system in accordance with a further embodiment of the present invention comprising a three connecting assemblies.
Figure 8:
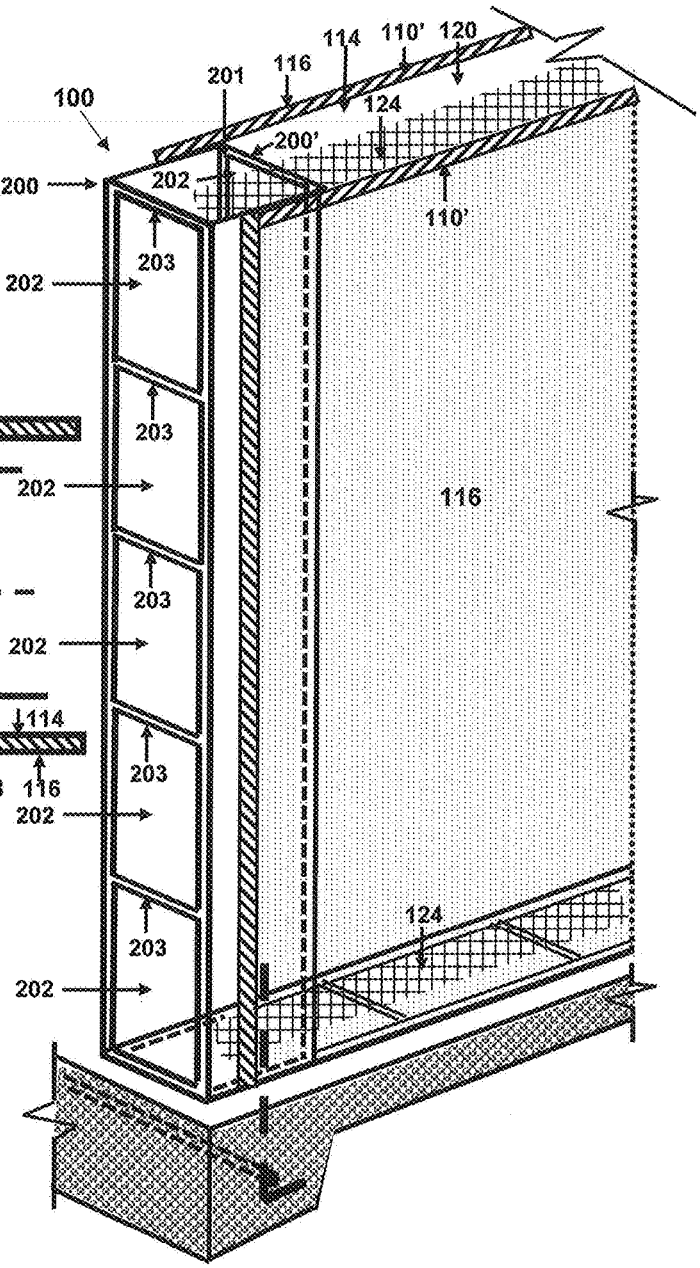
FIG. 8 is a perspective view of a portion of a panel assembly of the wall system in accordance with one embodiment of the present invention comprising a connecting assembly.

As is perhaps best shown in FIGS. 7-7B, a wire mesh layer 124 may be disposed between the two panel members 110', and substantially around a center portion 126 of the air gap 120'. As is shown at least in FIG. 5, a wire mesh layer 124 may be attached to one or more stems 203 of the connecting assembly 200'. This feature further facilitates providing a panel assembly 100' with a reduced thickness 122. This feature also facilitates maintaining a substantially centered disposition of the wire mesh layer 124 with respect to the two panel members 110' of a panel assembly 100'. As is perhaps best shown in FIG. 5, the wire mesh layer 124 may extend substantially along at least a portion of the width W1 of a panel member(s) 110'. The wire mesh layer may also extend substantially along the entirety of the width W1 of a panel member(s) 110'. To provide further structural support, two or more wire mesh layers 124 may be provided within the air gap 120' in an overlapping position, but again in a substantially perpendicular alignment with respect to the panel members 110'. In some embodiments, a wire mesh layer(s) 124 may be provided accordingly to eliminate the need to incorporate one or more connecting assemblies 200'. Alternatively, the wire mesh layer 124 may be continuous, and may extend across at least a portion of two or more adjacently disposed panel member(s) 110'. Further, the wire mesh layer 124 may extend along at least a portion of the height of a panel member(s) 110', and in some embodiments substantially along the entirety thereof. The wire mesh layer 124 may be disposed within the air gap 120' before casting of the filler 140'. The illustrative embodiment of FIG. 7B shows a 4' straight wire mesh disposed between 4' panel members 110', which may be surrounded by 3,000 psi concrete fill. In addition to the wire mesh layer 124, other components, i.e., pre-set features, may also be provided within the air gap 120. Pre-set features include, without limitation, reinforcing steel bars, wire mesh, plumbing stacks, electrical conduits, cables, etc., which may be placed between interconnected panel members 110' of a panel assembly 100', and which may extent the width W1, so that the filler 140' may be cast thereafter. For example, the illustrative embodiments of FIGS. 5-5A show some pre-set features which include pre-set plumbing stacks and pre-set electrical conduits.

As shown in FIGS. 7-7B and 5-5A, it is within the scope of the present invention that one or more panel assemblies 110' be connected to each other to form at least a portion of the structure of a building. A connecting assembly 200' may be provided to connect two different panel assemblies 100'. For example, as is shown at least in FIG. 5, a connecting assembly 200' may comprise a U-shaped channel 201 to which corresponding panel members 110' of different panel assemblies 100' may be connected. As a further example, as is shown at least in FIG. 10, a connecting assembly 200' may comprise two adjacently disposed "inverted" L-shaped channels 204 to which corresponding panel members 110' of different panel assemblies 100' may be connected. The structural channel(s) 201 and/or 204 may comprise structural steel or other suitable structural alloy. For example, the structural channel(s) 201 and/or 204 may comprise roll-formed steel. As is further shown at least in FIGS. 5-5A and 8-10, the connecting assembly 200' may also comprise one or more apertures 202 formed respectively on the U-shaped channel 201 or the L-shaped channel(s) 204. The apertures 202 are generally configured to facilitate flow of the filler 140' between adjacent air gaps 120', for example, of connected panel assemblies 100'. More specifically, filler may flow on either side of the apertures 202, between different structural components, such as between columns, between walls, between beams, or between combinations thereof. It is within the scope of the present invention that the size of the apertures 202 be sufficient to at least partially enable flow of the filler 140' between different zones. Said differently, the size of the apertures 202 should be sufficient to at least partially reduce restriction of the flow of the filler 140', reducing the need to incorporate vibrators, such as may be used in connection with concrete casting operations. The apertures 202 may be pre-punched, and further may be used as templates for installation of reinforcement members 128. As shown in FIGS. 9 and 10, which show an illustrative embodiments of corner configurations, one or more reinforcement members 128 may be disposed through an aperture 202, and between adjacent air gaps 120', and more specifically adjacent structural components, i.e., beams, columns, walls, and/or combinations thereof. In at least one embodiment, such reinforcement members 128 may be disposed between adjacent air gaps 120', extending through a corresponding aperture 202, and may also be spliced or otherwise connected to a foundation dowel. Furthermore, the reinforcement members 128 may comprise an L-shape such that they may be provided at corners of a building structure.

Figure 14:
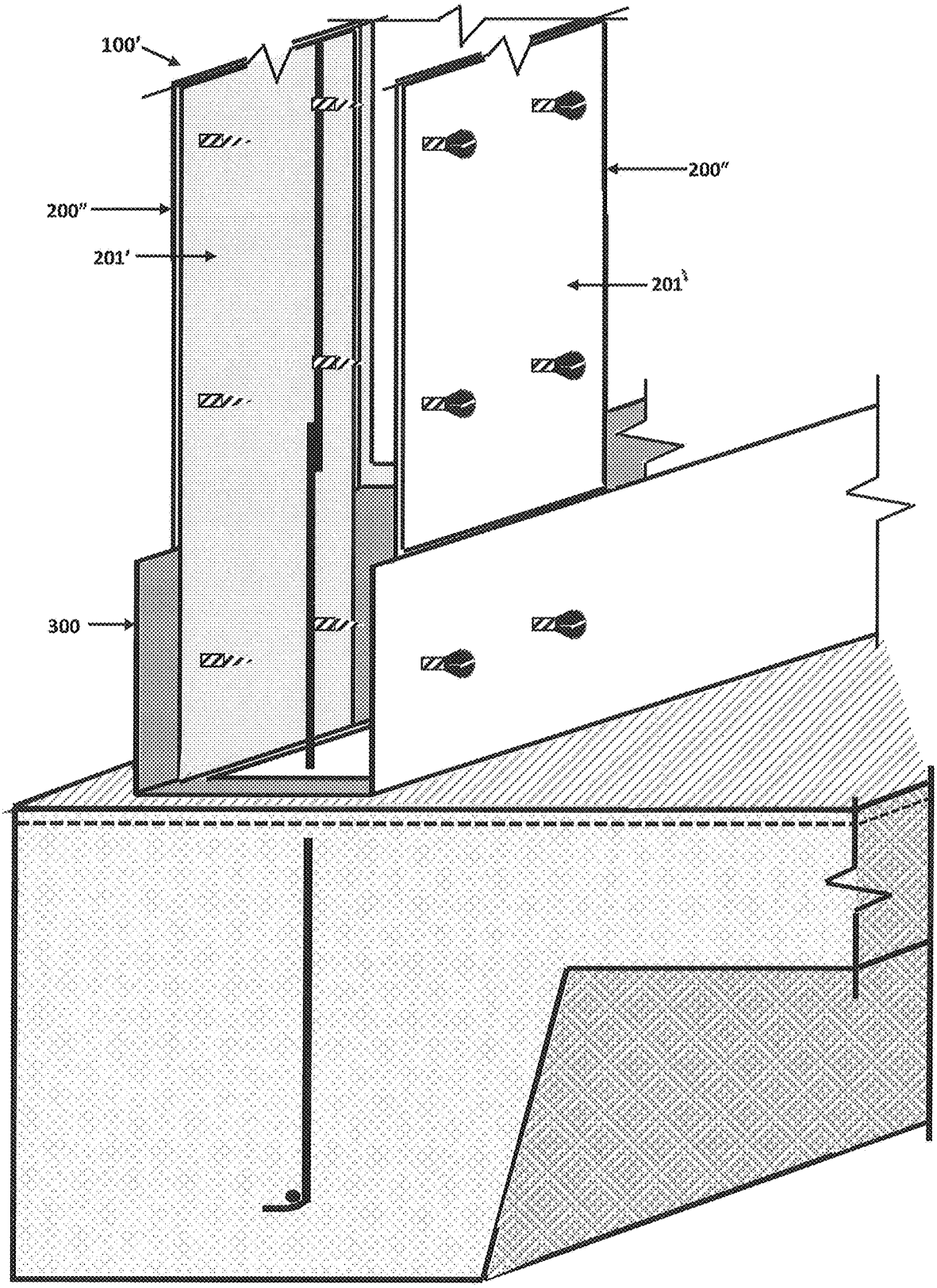
FIG. 14 is a perspective view of a portion of a panel assembly of the wall system in accordance with another embodiment of the present invention comprising a connecting assembly.
Figure 16:
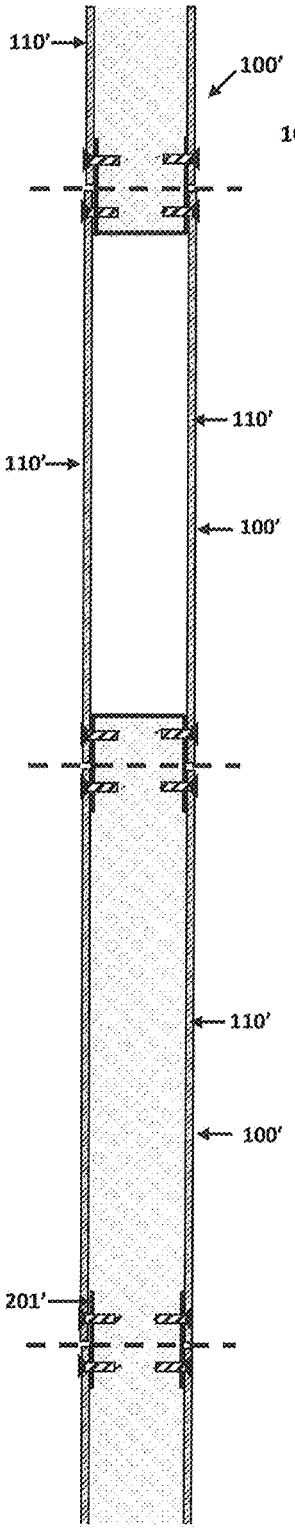
FIG. 16 is a side section view of a portion of a panel assembly of the wall system in accordance with a one embodiment according to the present invention.
Figure 15:
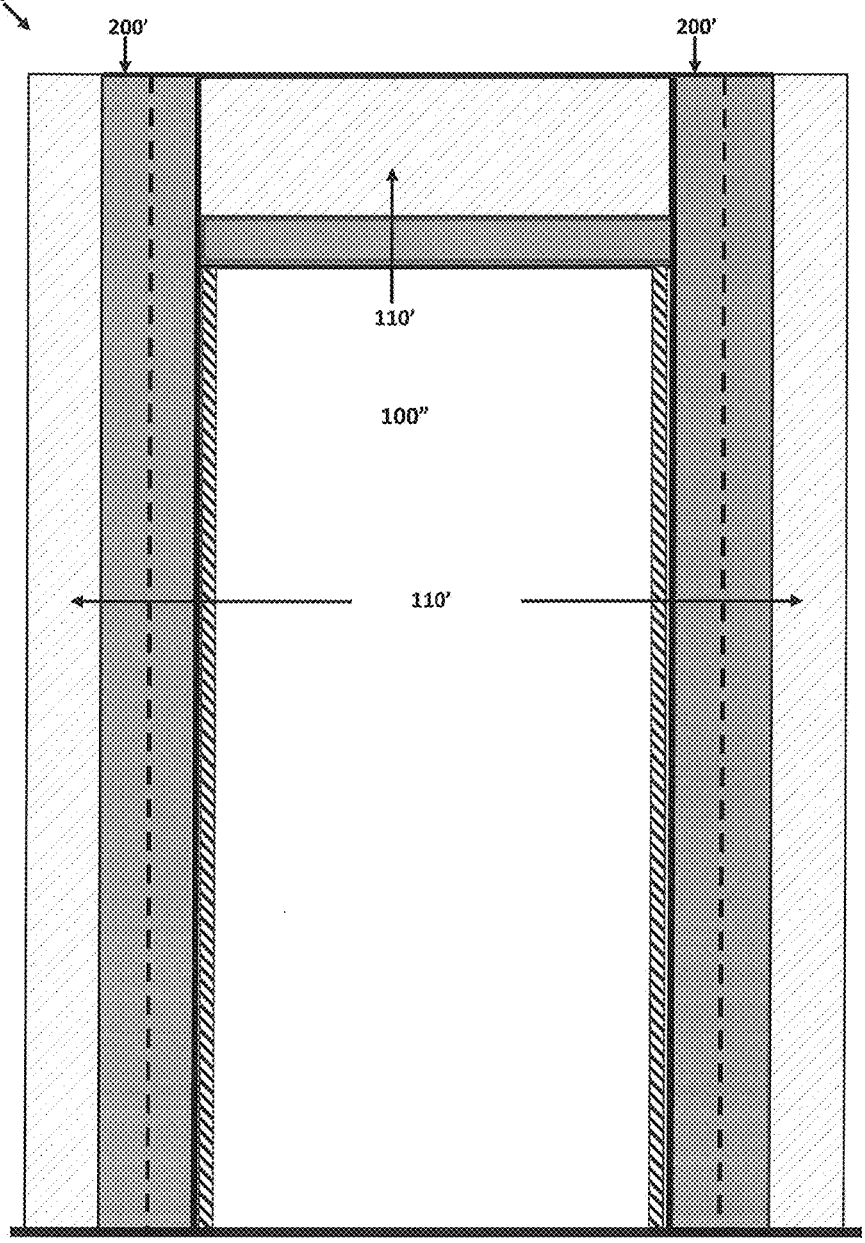
FIG. 15 is a perspective view of a panel assembly of the wall system in accordance with one embodiment of the present invention comprising an exterior door aperture.

With reference now to FIG. 14, further features of the present invention comprise providing a connection assembly 200' with one or more vertical plates 201' in lieu of structural channels 201 and/or 204. In such embodiments, it is beneficial to provide a base member 300 as described herein. A base member 300 provides proper alignment and support for the vertical plates 201'. In at least one embodiment such vertical plates 201' comprise steel plates, and as such, these allow for a wire mesh layer(s) 124 to extend therebetween, and beyond panel members to create different increased sections holding the wire mesh layer 124 in place while the filler 140', e.g., liquid concrete, is being placed within the air gap 120'. Such a base member 300 is not strictly necessary for other embodiments incorporating structural channel(s), i.e., 201 and/or 204. However, if desired, it is possible to incorporate a base member 300 for those embodiments that incorporate structural channel(s). However, such base members 300 are not strictly necessary. Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A wall system comprising:

at least two rigid channels;

at least two panel members, each secured at opposite ends thereof to opposite sides of said channels so as to be positioned in spaced, interconnecting relation with one another and define a panel assembly;

an air gap defined between said panel members;

each one of said two panel members comprising an inside face and an oppositely disposed outside face, said inside face of said panel members secured to said channels so as to position said channels entirely within said air gap, at least two panel assemblies structured to abut and be secured to one another at said channels to conceal and contain said channels in said air gap, said outside faces of said panel members defining a uniform exterior surface, said air gap having a thickness of less than approximately 4 inches and each of said panel members having a thickness of less than approximately 5/16 inches, said panel members formed of a rigid, moisture resistant material structured to define an exterior wall surface, and configured to at least partially reduce deflecting and decay, at least two removable support members, each one disposed on a corresponding outside face of one of said two panel members, a filler disposed within said air gap and engaging only said inside face of said panel members, said filler comprising concrete and said panel members structured to contain said concrete and provide support thereto during and after hardening of said concrete, said removable support members secured to one another and being substantially rigid in a vertical orientation and structured to prevent said panel members from separating or buckling during hardening of said concrete in said airgap; and said panel assembly including said filler contained in said air gap structured to define an exterior sheer wall upon hardening of said filler, said uniform exterior surface defining a weather resistant exposed face of said exterior sheer wall.

2. The wall system as recited in claim 1 wherein said panel assembly is pre-assembled in a controlled environment.

3. The wall system as recited in claim 1 wherein said panel assembly is assembled at a job site.

4. The wall system as recited in claim 1 wherein said filler comprises lightweight concrete.

5. The wall system as recited in claim 4 wherein said filler comprises light weight concrete, slate, and volcano compounds.

6. The wall system as recited in claim 1 wherein said outside face of said panel members comprises a substantially smooth finished appearance after hardening of said concrete in said air gap and upon removal of said support members.

7. The wall system as recited in claim 1 wherein at least one of said two panel members comprises fiber cement.

8. The wall system as recited in claim 1 wherein at least one of said two panel members comprises a compound at least partially disposed on said outside face.

9. The wall system as recited in claim 1 wherein at least one of said two panel members comprises a thickness of about 6 millimeters.

10. The wall system as recited in claim 1 wherein removable support members comprise corrugated steel panels, ridges of said steel panels being vertically aligned so as to provide added strength in a vertical orientation.

11. The wall system as recited in claim 1 further comprising a wire mesh layer disposed within said air gap.

12. The wall system as recited in claim 11 wherein said wire mesh layer is secured in a generally centered vertical orientation within said air gap in a substantially parallel orientation to said two panel members.

13. A wall system comprising:

two panel members disposed in spaced, interconnecting relation, and collectively defining a panel assembly;

an air gap of no more than about 4 inches between said panel members, concrete disposed within said air gap, each of said two panel members having a thickness of no more than about 6 mm and comprising an inside face and an oppositely disposed outside face, each one of said two panel members comprising fiber cement, at least two removable support members, said removable support members on opposite sides of said air gap secured to one another and each of said removable support members structured to temporarily engage and support a corresponding outside face of one of said two panel members, each of said two removable support members comprising corrugated steel panels, each one of said two panel members comprising a first predetermined width of no more than about 4 feet, each of said two removable support members comprising a second predetermined width, and said first predetermined width greater than said second predetermined width;

a plurality of said panel assemblies being disposed in abutting relation with one another, said support members of adjacent ones of said panel members structured to overlap one another to define a continuous support of said panel members during hardening of said concrete.

14. The wall system as recited in claim 13 wherein said first predetermined width is about 4 feet.

15. The wall system as recited in claim 13 wherein said second predetermined width is about 2 feet.

16. A wall system comprising:

a plurality of panel assemblies, each of said plurality of panel assemblies comprising two panel members disposed in spaced, interconnected relation, and collectively defining an air gap of no more than about 4 inches therebetween, concrete disposed within said air gap, each of said two panel members comprising an inside face and an oppositely disposed outside face, at least two connectors secured to said inside face of each of said two panel members at opposite ends of said two panel members, said connectors contained completely within said air gap such that said outside face of said panel members define a continuous, uniform exterior surface of said panel assembly, each one of said two panel members comprising fiber cement and having a thickness of less than about 8 mm, a strength of said fiber cement and said concrete collectively defining an exterior sheer wall;

at least two removable support members for each of said panel assembles, each of said removable support members disposed on a corresponding outside face of one of said two panel members of each panel assembly and secured to one another to prevent said panel members from buckling during hardening of said concrete, and each of said two removable support members comprising corrugated steel panels.

17. The wall system as recited in claim 16 wherein said at least one connectors comprises a U-shaped channel comprising at least one aperture configured to facilitate flow between adjacent air gaps of said at least two of said plurality of panel assemblies.

18. The wall system as recited in claim 17 further comprising at least one reinforcement member disposed between adjacent air gaps and extending through said at least one aperture.

19. The wall system as recited in claim 12 wherein said wire mesh is centered in said air gap and is spaced at least 1½ inches from both of said panel members.

* * * * *